US011075462B2

(12) United States Patent
Suzuki et al.

(10) Patent No.: US 11,075,462 B2
(45) Date of Patent: Jul. 27, 2021

(54) ANTENNA DEVICE

(71) Applicant: Sony Corporation, Tokyo (JP)

(72) Inventors: Yuichiro Suzuki, Tokyo (JP); Shen Wang, Tokyo (JP); Takayoshi Ito, Tokyo (JP); Toru Ozone, Tokyo (JP); Jin Sato, Tokyo (JP)

(73) Assignee: SONY CORPORATION, Tokyo (JP)

( * ) Notice: Subject to any disclaimer, the term of this patent is extended or adjusted under 35 U.S.C. 154(b) by 44 days.

(21) Appl. No.: 16/619,968

(22) PCT Filed: Feb. 15, 2018

(86) PCT No.: PCT/JP2018/005297
§ 371 (c)(1),
(2) Date: Dec. 6, 2019

(87) PCT Pub. No.: WO2018/230039
PCT Pub. Date: Dec. 20, 2018

(65) Prior Publication Data

US 2020/0144729 A1 May 7, 2020

(30) Foreign Application Priority Data

Jun. 14, 2017 (JP) ..... JP2017-116760

(51) Int. Cl.
*H01Q 13/10* (2006.01)
*H01Q 21/06* (2006.01)
(Continued)

(52) U.S. Cl.
CPC ..... *H01Q 13/10* (2013.01); *H01Q 1/48* (2013.01); *H01Q 21/064* (2013.01); *H01Q 21/24* (2013.01)

(58) Field of Classification Search
CPC ..... H01Q 13/10; H01Q 13/106; H01Q 9/04; H01Q 9/0407; H01Q 21/06; H01Q 21/061;
(Continued)

(56) References Cited

U.S. PATENT DOCUMENTS 6,239,762 B1 * 5/2001 Lier ..... H01Q 13/10 343/700 MS
6,377,217 B1 * 4/2002 Zhu ..... H01P 1/181 343/700 MS
(Continued)

FOREIGN PATENT DOCUMENTS

CN 101316008 B 6/2012
JP 10-200326 A 7/1998
(Continued)

OTHER PUBLICATIONS

International Search Report and Written Opinion dated Apr. 24, 2018 for PCT/JP2018/005297 filed on Feb. 15, 2018, 8 pages including English Translation of the International Search Report.
(Continued)

*Primary Examiner* — Jason Crawford
(74) *Attorney, Agent, or Firm* — Xsensus LLP

(57) ABSTRACT

To obtain a more favorable radiation pattern even in a case of arraying a plurality of antenna elements.
An antenna device includes a dielectric substrate, a plurality of antenna elements that disposed along a first direction and respectively transmits or receives a first wireless signal and a second wireless signal having different polarization directions from one another, and a ground plate provided with a long slot to extend in a second direction in a region corresponding to a region between first and second antenna elements next to each other, and a length L in the second
(Continued)

direction of the slop satisfies a conditional expression below where a wavelength of the wireless signal is $\lambda_0$, a relative dielectric constant of the dielectric substrate is $\varepsilon_{r1}$, and a relative dielectric constant of a dielectric located on an opposite side of the dielectric substrate with respect to the ground plate is $\varepsilon_{r2}$.

[Math. 1]

$$L > \frac{\lambda_g}{2}, \lambda_g = \frac{\lambda_0}{\sqrt{(\varepsilon_{r1} + \varepsilon_{r2})/2}}$$

8 Claims, 24 Drawing Sheets

(51) Int. Cl.
*H01Q 21/24* (2006.01)
*H01Q 1/48* (2006.01)

(58) Field of Classification Search
CPC .... H01Q 21/064; H01Q 21/065; H01Q 21/24; H01Q 21/245; H01Q 21/28; H01Q 21/29; H01Q 21/30
See application file for complete search history.

(56) References Cited

U.S. PATENT DOCUMENTS 9,755,306 B1 * 9/2017 Ogilvie ..... H01Q 9/0414
10,320,089 B2 * 6/2019 Jakoby ..... H01Q 3/34
2002/0122006 A1 9/2002 Crawford
2003/0122715 A1 * 7/2003 Aikawa ..... H01Q 9/0457 343/700 MS
2003/0193437 A1 10/2003 Kangasvieri et al.
2009/0046017 A1 * 2/2009 Foo ..... H01Q 1/40 343/700 MS
2012/0235881 A1 9/2012 Pan et al.

FOREIGN PATENT DOCUMENTS

JP 2003-198240 A 7/2003
JP 2005-072653 A 3/2005
JP 2007-142876 A 6/2007

OTHER PUBLICATIONS

Office Action dated Sep. 1, 2020, in corresponding Chinese patent Application No. 201880046521.7, 13 pages.
Office Action dated Nov. 10, 2020, in corresponding Japanese patent Application No. 2019-525071, 11 pages.
Ouyang J et al: "Reducing Mutual Coupling of Closely Spaced Microstrip MIMO Antennas for WLAN Application", IEEE Antennas and Wireless Propagation Letters, IEEE, Piscataway, NJ, US, vol. 10, Jan. 1, 2011 (Jan. 1, 2011), pp. 310-313, XP011480385, ISSN: 1536-1225, DOI: 10.1109/LAWP.2011.2140310.
Wang Chien-Jen et al: "Modeling of Stepped-Impedance Slot Antenna", IEEE Transactions on Antennas and Propagation, IEEE Service Center, Piscataway, NJ, US, vol. 62, No. 2, Feb. 1, 2014 (Feb. 1, 2014), pp. 955-959, XP011538743, ISSN: 0018-926X, DOI: 10.1109/TAP.2013.2291906.
Asieh Habashi et al: "A rectangular defected ground structure (DGS) for reduction of mutual coupling between closely-spaced microstrip antennas", Electrical Engineering (ICEE), 2012 20th Iranian Conference On, IEEE, May 15, 2012 (May 15, 2012), pp. 1347-1350, XP032231868, DOI: 10.1109/IRANIANCEE.2012.6292566 ISBN: 978-1-4673-1149-6 sections 2. and 3.;p. 1348-p. 1349; figure 1; Table I.
Mohsen Salehi et al: "Elimination of scan blindness in microstrip scanning array antennas using defected ground structure", Microwave Conference, 2007. European, IEEE, PI, Oct. 1, 2007 (Oct. 1, 2007), pp. 482-484, XP031191840, DOI: 10.1109/EUMC.2007.4405232ISBN: 978-2-87487-001-9 section I I I .; p. 483; figure 4.
Extended European Search Report dated May 25, 2020, issued in corresponding European Patent Application No. 18817484.1.

* cited by examiner

ANTENNA DEVICE

TECHNICAL FIELD

The present disclosure relates to an antenna device.

BACKGROUND ART

In a mobile communication system based on a communication standard called LTE/LTE-advanced (A), a wireless signal having a frequency called ultra high frequency around 700 MHz to 3.5 GHz is mainly used for communication.

Furthermore, in communication using ultra-high frequencies like the above-described communication standard, a so-called multiple-input and multiple-output (MIMO) technology is adopted to further improve communication performance using reflected waves in addition to direct waves in signal transmission/reception even under a fading environment. Since a plurality of antennas is used in MIMO, various techniques for arranging the plurality of antennas in a more favorable manner for mobile communication terminal devices such as smartphones have been studied.

Furthermore, in recent years, various studies have been made on a fifth generation (5G) mobile communication system following LTE/LTE-A. For example, in the mobile communication system, use of communication using a wireless signal (hereinafter also simply referred to as "millimeter wave") having a frequency called millimeter wave such as 28 GHz or 39 GHz is being studied.

The millimeter wave can increase the amount of information to be transmitted as compared with the ultra high frequency wave, whereas the millimeter wave has high straightness and tends to increase propagation loss and reflection loss. For this reason, in wireless communication using the millimeter wave, it has been found that direct waves mainly contribute to communication characteristics and are hardly affected by reflected waves. Because of such characteristics, in the 5G mobile communication system, introduction of a technology called polarization MIMO, which implements MIMO using a plurality of polarized waves with different polarization directions from each other (for example, a horizontal polarized wave and a vertical polarized wave), is also being discussed.

CITATION LIST

Patent Document

Patent Document 1: Japanese Patent Application Laid-Open No. 2005-72653

SUMMARY OF THE INVENTION

Problems to be Solved by the Invention

By the way, in general, the millimeter wave has a relatively large spatial attenuation, and in a case of using the millimeter wave for communication, an antenna having a high gain tends to be required. To realize such a demand, a so-called beam forming technology may be used. Specifically, the gain of the antenna can be further improved by controlling the beam width of the antenna by beam forming and improving the directivity of the beam. An example of an antenna system that can realize such control includes a patch array antenna. For example, Patent Document 1 discloses an example of the patch array antenna.

Meanwhile, there is a possibility of occurrence of a distortion in a radiation pattern of at least some of a plurality of antenna elements (for example, patch antennas) by arraying the antenna elements. As described above, when a distortion occurs in the radiation pattern, there are some cases where obtainment of a desired gain in at least a part of a predetermined space is difficult.

Therefore, the present disclosure proposes an example of a technology capable of obtaining a more favorable radiation pattern even in a case of arraying a plurality of antenna elements.

Solutions to Problems

According to the present disclosure, an antenna device is provided, which includes a substantially planar dielectric substrate, a plurality of antenna elements disposed on one surface of the dielectric substrate along a first direction horizontal to a plane of the dielectric substrate, and configured to respectively transmit or receive a first wireless signal and a second wireless signal having different polarization directions from one another, and a ground plate provided on substantially entire the other surface of the dielectric substrate, and provided with a long slot to extend in a second direction orthogonal to the first direction in a region corresponding to a region between a first antenna element and a second antenna element next to each other, in which a length L in the second direction of the slop satisfies a conditional expression below, where a wavelength of a center frequency of respective resonance frequencies of the plurality of antenna elements is $\lambda_0$, a relative dielectric constant of the dielectric substrate is $\varepsilon_{r1}$, and a relative dielectric constant of a dielectric located on an opposite side of the dielectric substrate with respect to the ground plate is $\varepsilon_{r2}$.

[Math 1]

$$L > \frac{\lambda_g}{2}, \lambda_g = \frac{\lambda_0}{\sqrt{(\varepsilon_{r1} + \varepsilon_{r2})/2}}$$

Effects of the Invention

As described above, according to the present disclosure, there is provided a technology capable of obtaining a more favorable radiation pattern even in a case of arraying a plurality of antenna elements.

Note that the above-described effect is not necessarily restrictive, and any one of effects described in the present specification or any another effect obtainable from the present specification may be exhibited in addition to or in place of the above-described effect.

MODE FOR CARRYING OUT THE INVENTION

Favorable embodiments of the present disclosure will be described in detail with reference to the appended drawings. Note that, in the present specification and drawings, overlapping description of configuration elements having substantially the same functional configuration is omitted by providing the same sign.

Note that the description will be given in the following order.

1. Schematic Configuration
1.1. Example of System Configuration
1.2. Functional Configuration of Terminal Device
1.3. Configuration Example of Terminal Device
2. Study on Communication Using Millimeter Wave
3. Technical Characteristics
3.1. Configuration
3.2. Modification
3.3. Example
3.4. Application
4. Conclusion

1. SCHEMATIC CONFIGURATION

1.1 Example of System Configuration

Figure 1:
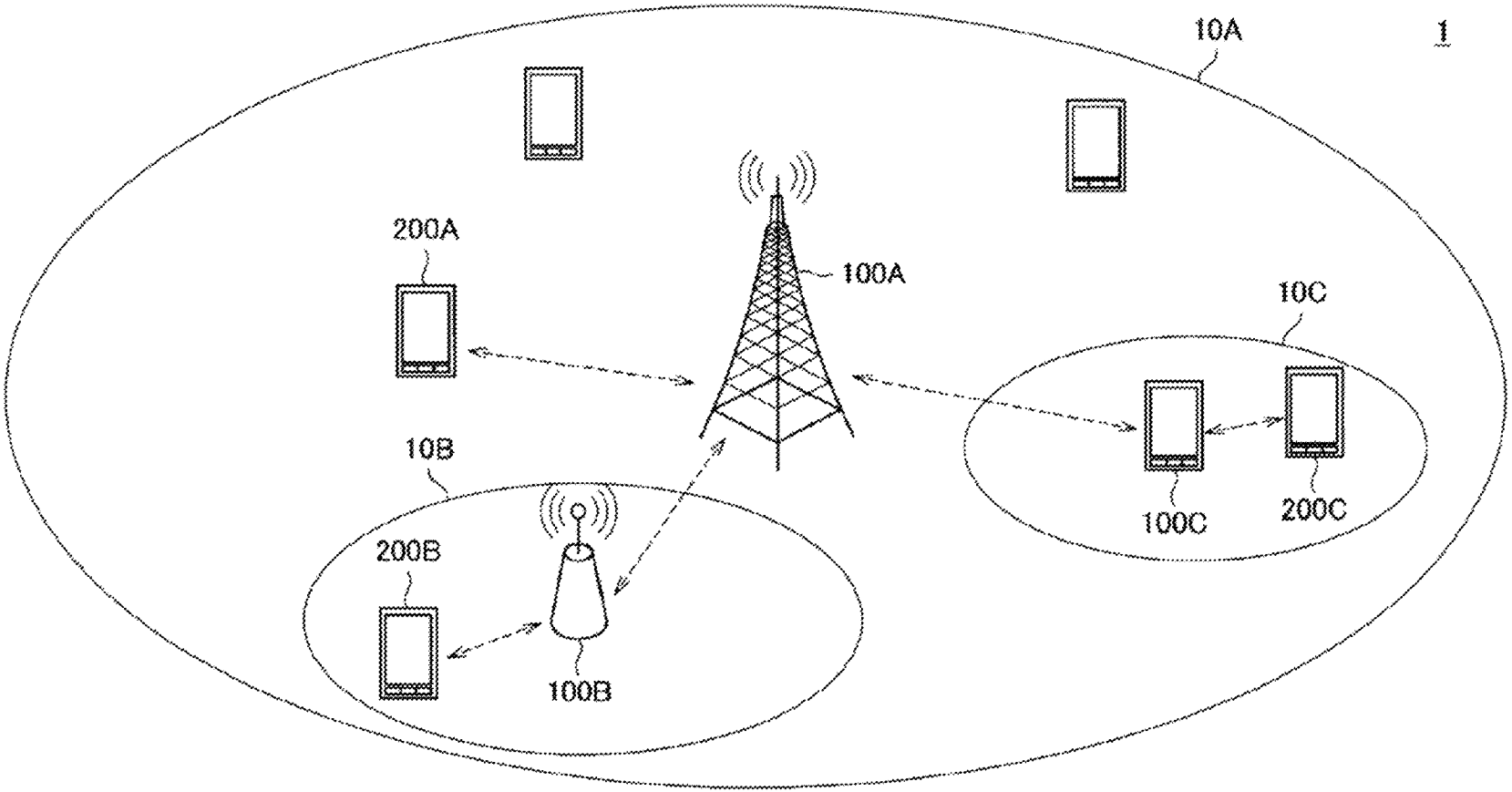
FIG. 1 is an explanatory diagram for describing an example of a schematic configuration of a system according to an embodiment of the present disclosure.

First, an example of a schematic configuration of a system 1 according to an embodiment of the present disclosure will be described with reference to FIG. 1. FIG. 1 is an explanatory diagram for describing an example of a schematic configuration of the system 1 according to an embodiment of the present disclosure. As illustrated in FIG. 1, the system 1 includes a wireless communication device 100 and a terminal device 200. Here, the terminal device 200 is also called user. The user may also be referred to as a UE. A wireless communication device 100C is also called UE-Relay. The UE here may be a UE defined in LTE or LTE-A, and the UE-Relay may be a Prose UE to Network Relay discussed in 3GPP and more generally may mean communication equipment.

(1) Wireless Communication Device 100

The wireless communication device 100 is a device that provides a wireless communication service to subordinate devices. For example, a wireless communication device 100A is a base station of a cellular system (or a mobile communication system). The base station 100A performs wireless communication with a device (for example, a terminal device 200A) located inside a cell 10A of the base station 100A. For example, the base station 100A transmits a downlink signal to the terminal device 200A and receives an uplink signal from the terminal device 200A.

The base station 100A is logically connected to another base station through, for example, an X2 interface, and can transmit and receive control information and the like. Furthermore, the base station 100A is logically connected to a so-called core network (not illustrated) through, for example, an S1 interface, and can transmit and receive control information and the like. Note that the communication between these devices can be physically relayed by various devices.

Here, the wireless communication device 100A illustrated in FIG. 1 is a macro cell base station, and the cell 10A is a macro cell. Meanwhile, wireless communication devices 100B and 100C are master devices that operate small cells 10B and 10C, respectively. As an example, the master device 100B is a small cell base station that is fixedly installed. The small cell base station 100B establishes a wireless backhaul link with the macro cell base station 100A, and an access link with one or more terminal devices (for example, a terminal device 200B) in the small cell 10B. Note that the wireless communication device 100B may be a relay node defined by 3GPP. The master device 100C is a dynamic access point (AP). The dynamic AP 100C is a mobile device that dynamically operates the small cell 10C. The dynamic AP 100C establishes a wireless backhaul link with the macro cell base station 100A, and an access link with one or more terminal devices (for example, a terminal device 200C) in the small cell 10C. The dynamic AP 100C may be a terminal device equipped with hardware or software capable of operating as a base station or a wireless access point, for example. The small cell 10C in this case is a dynamically formed local network (localized network/virtual cell).

The cell 10A may be operated according to an arbitrary wireless communication system such as LTE, LTE-Advanced (LTE-A), LTE-ADVANCED PRO, GSM (registered trademark), UMTS, W-CDMA, CDMA200, WiMAX, WiMAX2, or IEEE802.16, for example.

Note that the small cell is a concept that can include various types of cells (for example, a femto cell, a nano cell, a pico cell, a micro cell, and the like) that are smaller than the macro cell and are arranged overlapping or not overlapping with the macro cell. In one example, the small cell is operated by a dedicated base station. In another example, the small cell is operated by a terminal serving as a master device temporarily operating as a small cell base station. So-called relay nodes can also be considered as a form of small cell base station. A wireless communication device that functions as a master station of a relay node is also referred to as a donor base station. The donor base station may mean a DeNB in LTE or more generally a parent station of the relay node.

(2) Terminal Device 200

The terminal device 200 can communicate in a cellular system (or mobile communication system). The terminal device 200 performs wireless communication with a wireless communication device (for example, the base station 100A or the master device 100B or 100C) in the cellular system. For example, the terminal device 200A receives a downlink signal from the base station 100A and transmits an uplink signal to the base station 100A.

Furthermore, the terminal device 200 is not limited to only a so-called UE, and for example, a so-called low cost terminal (low cost UE) such as an MTC terminal, an enhanced MTC (eMTC) terminal, and an NB-IoT terminal may be applied.

(3) Supplement

The schematic configuration of the system 1 has been described, but the present technology is not limited to the example illustrated in FIG. 1. For example, as the configuration of the system 1, a configuration that does not include a master device, such as small cell enhancement (SCE), heterogeneous network (HetNet), or an MTC network, can be adopted. Furthermore, as another example of the configuration of the system 1, a master device may be connected to a small cell and construct a cell under the small cell.

An example of a schematic configuration of the system 1 according to the embodiment of the present disclosure has been described with reference to FIG. 1.

1.2 Functional Configuration of Terminal Device

Figure 2:
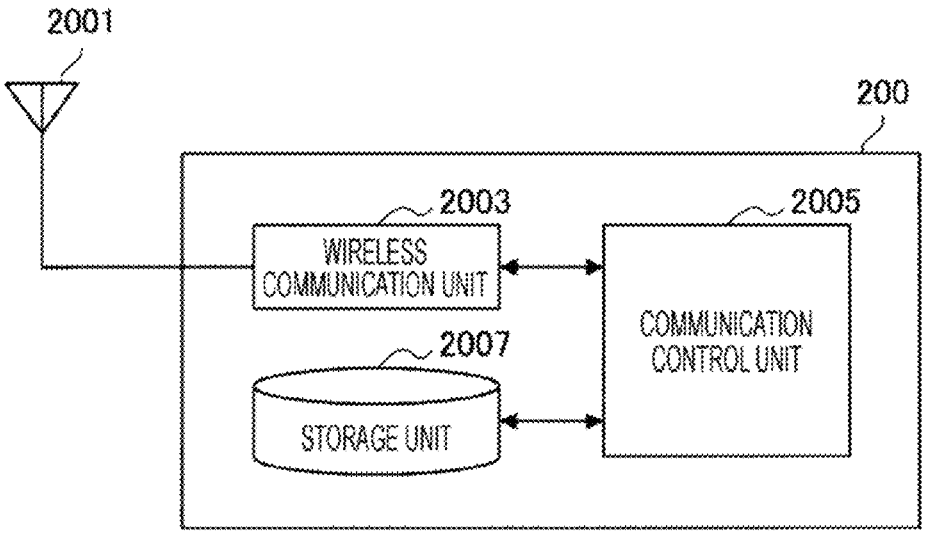
FIG. 2 is a block diagram illustrating an example of a configuration of a terminal device according to the present embodiment.

Next, an example of a functional configuration of the terminal device 200 according to the embodiment of the present disclosure will be described with reference to FIG. 2. FIG. 2 is a block diagram illustrating an example of a configuration of the terminal device 200 according to the embodiment of the present disclosure. As illustrated in FIG. 2, the terminal device 200 includes an antenna unit 2001, a wireless communication unit 2003, a storage unit 2007, and a communication control unit 2005.

(1) Antenna Unit 2001

The antenna unit 2001 radiates a signal output from the wireless communication unit 2003 into a space as a radio wave. Furthermore, the antenna unit 2001 converts the radio wave in the space into a signal and outputs the signal to the wireless communication unit 2003.

(2) Wireless Communication Unit 2003

The wireless communication unit 2003 transmits and receives a signal. For example, the wireless communication unit 2003 receives a downlink signal from the base station and transmits an uplink signal to the base station.

(3) Storage Unit 2007

The storage unit 2007 temporarily or permanently stores a program and various data for the operation of the terminal device 200.

(4) Communication Control Unit 2005

The communication control unit 2005 controls communication with another device (for example, the base station 100) by controlling the operation of the wireless communication unit 2003. As a specific example, the communication control unit 2005 may modulate data to be transmitted on the basis of a predetermined modulation method to generate a transmission signal, and may cause the wireless communication unit 2003 to transmit the transmission signal to the base station 100. Furthermore, as another example, the communication control unit 2005 may acquire, from the wireless communication unit 2003, a reception result (that is, a reception signal) of a signal from the base station 100, and may apply predetermined demodulation processing to the reception signal to demodulate data transmitted from the base station 100.

An example of the functional configuration of the terminal device 200 according to the embodiment of the present disclosure has been described with reference to FIG. 2.

1.3. Configuration Example of Communication Device

Next, as an example of a configuration of a communication device according to the present embodiment, an example of case where a so-called patch array antenna having arrayed patch antennas (planar antennas) is applied to a communication device such as the above-described terminal device 200 will be described.

Figure 3:
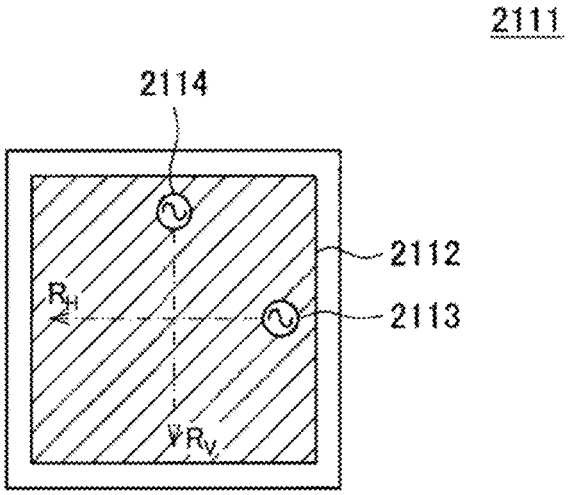
FIG. 3 is an explanatory view for describing an outline of a patch antenna.

First, an outline of a patch antenna will be described with reference to FIG. 3. FIG. 3 is an explanatory view for describing an outline of a patch antenna. As an example of a generally known antenna, a so-called dipole antenna has a rod-like element, and thus a current flows in one direction, and only one polarized wave can be transmitted or received. In contrast, the patch antenna can flow current in a plurality of directions by providing a plurality of feeding points. For example, a patch antenna 2111 illustrated in FIG. 3 is provided with a plurality of feeding points 2113 and 2114 on a planar element 2112, and is configured to be able to transmit or receive a polarized wave $R_H$ and a polarized wave $R_V$ having different polarization directions from each other (perpendicular to each other).

Figure 4:
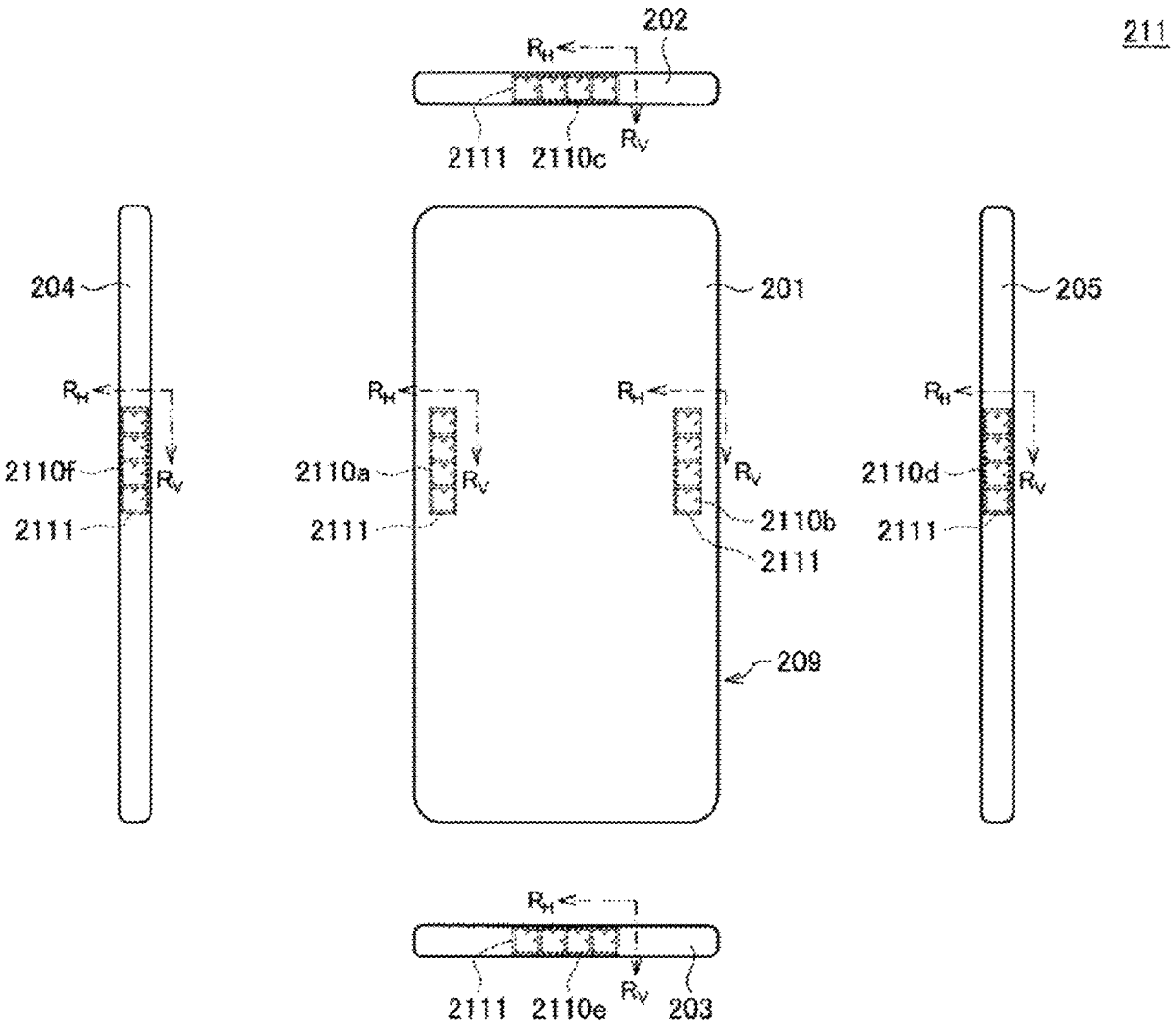
FIG. 4 is an explanatory view for describing an example of a configuration of a communication device according to the embodiment.

Next, an example of a configuration of a communication device according to the present embodiment will be described with reference to FIG. 4. FIG. 4 is an explanatory view for describing an example of a configuration of a communication device according to the present embodiment. Note that, in the following description, the communication device according to the present embodiment may be referred to as a "communication device 211".

The communication device 211 according to the present embodiment includes a plate-like housing 209 having a front surface and a back surface having a substantially rectangular shape. Note that, in the present description, a surface on a side provided with a display unit such as a display is referred to as a front surface. That is, in FIG. 4, the reference numeral 201 denotes the back surface of outer surfaces of the housing 209. Furthermore, the reference numerals 203 and 205 correspond to end surfaces located in a periphery of the back surface 201 of the outer surfaces of the housing 209, and more specifically denote end surfaces extending in a longitudinal direction of the back surface 201. Furthermore, the reference numerals 202 and 204 correspond to end surfaces located in the periphery of the back surface 201 of the outer surfaces of the housing 209, and more specifically denote end surfaces extending in a short direction of the back surface 201. Note that the front surface located on the opposite side of the back surface 201 is also referred to as "front surface 206" for convenience although illustration is omitted in FIG. 3.

Furthermore, in FIG. 4, the reference numerals 2110*a* to 2110*f* denote antenna devices for transmitting and receiving wireless signals (for example, millimeter waves) to and from the base station. Note that, in the following description, the antenna devices 2110*a* to 2110*f* may be simply referred to as "antenna device(s) 2110" unless otherwise distinguished.

As illustrated in FIG. 4, the communication device 211 according to the present embodiment includes antenna devices 2110 inside the housing 209 to be located in vicinities of at least parts of the back surface 201 and the end surfaces 202 to 205, respectively.

Furthermore, the antenna device 2110 includes a plurality of antenna elements 2111. More specifically, the antenna device 2110 is configured as an array antenna by arraying the plurality of antenna elements 2111. For example, an antenna element 2111*a* is held to be located near an end portion of the back surface 201 on the end surface 204 side, and has a plurality of antenna elements 2111 provided to be arrayed along a direction in which the end portion extends (that is, the longitudinal direction of the end surface 204). Furthermore, an antenna element 2111*d* is held to be located near a part of the end surface 205, and has a plurality of antenna elements 2111 provided to be arrayed along the longitudinal direction of the end surface 205.

Furthermore, in the antenna device 2110 held to be located near a certain surface, each antenna element 2111 is held such that a normal direction of a planar element (for example, the element 2112 illustrated in FIG. 3) substantially coincides with a normal direction of the planar surface. In a case of focusing on the antenna device 2110*a* as a more specific example, the antenna element 2111 provided in the antenna device 2110*a* is held such that the normal direction of the planar element substantially coincides with the normal direction of the back surface 201. This similarly applies to the other antenna devices 2110*b* to 2110*f*.

With the above configuration, each antenna device 2110 controls phases and power of wireless signals transmitted or received by the plurality of antenna elements 2111, thereby controlling (that is, performing beam forming for) directivities of the wireless signals.

An example of the configuration of the communication device according to the present embodiment has been described with reference to FIG. 4. Note that the above-described configuration of the antenna device 2110 is merely an example, and does not necessarily limit the configuration of the antenna device 2110. For example, positions where the plurality of antenna elements 2111 is arranged are not limited as long as each of the plurality of antenna elements 2111 can transmit or receive the wireless signal propagating in a direction substantially coincident with the normal direction of the surface having the antenna device 2110 held in a vicinity. That is, the plurality of antenna elements 2111 is not necessarily arrayed only along one direction as illustrated in FIG. 4. For example, the plurality of antenna elements 2111 may be arrayed in a matrix manner.

2. STUDY ON COMMUNICATION USING MILLIMETER WAVE

In a communication system based on a standard such as LTE/LTE-A, a wireless signal having a frequency called ultra high frequency around 700 MHz to 3.5 GHz is used for communication. In contrast, in a fifth generation (5G) mobile communication system following LTE/LTE-A, use of communication using a wireless signal (hereinafter also simply referred to as "millimeter wave") having a frequency called millimeter wave such as 28 GHz or 39 GHz is being studied. Therefore, after describing an outline of communication using millimeter waves, technical problems of the communication device according to an embodiment of the present disclosure will be organized.

In the communication using ultra-high frequencies like LTE/LTE-A, a so-called multiple-input and multiple-output (MIMO) technology is adopted, thereby further improving communication performance using reflected waves in addition to direct waves in signal transmission/reception even under a fading environment.

In contrast, the millimeter wave can increase the amount of information to be transmitted as compared with the ultra high frequency wave, whereas the millimeter wave has high straightness and tends to increase propagation loss and reflection loss. Therefore, in an environment (a line of site (so-called LOS)) where there are no obstacles on a path directly connecting antennas that transmit and receive wireless signals, the direct waves mainly contribute to communication characteristics without being hardly affected by reflected waves. From such characteristics, in the communication using millimeter waves, for example, a communication terminal such as a smartphone receives a wireless signal (that is, a millimeter wave) directly transmitted from a base station (that is, receives the direct wave), thereby further improving the communication performance.

Meanwhile, in general, the millimeter wave has a relatively large spatial attenuation, and in a case of using the millimeter wave for communication, an antenna having a high gain tends to be required. To realize such a higher gain, a so-called beam forming technology may be used, for example. Specifically, the gain of the antenna can be further improved by controlling the beam width of the antenna by beam forming and improving the directivity of the beam. However, when the directivity of the beam is improved, the beam width becomes narrower, and there are some cases where a space covered by the antenna is limited. Therefore, in such a case, for example, there are some cases where a wider space is covered by the antenna by controlling the direction of the beam in a time division manner. An example of an antenna system that can realize such control includes a patch array antenna.

Meanwhile, there is a possibility of occurrence of a distortion in a radiation pattern of at least some of a plurality of antenna elements (for example, patch antennas) by arraying the antenna elements. Here, examples of distortion of a radiation pattern caused by arraying the plurality of antenna elements will be described with reference to FIGS. 5 to 8. FIGS. 5 to 8 are explanatory views for describing examples of distortion of a radiation pattern caused by arraying a plurality of antenna elements. Note that, in the present description, an example of a simulation result of a radiation pattern will be described using the case where a patch antenna (planar antenna) as described with reference to FIG. 3 is applied as the antenna element. Furthermore, in the examples illustrated in FIGS. 5 to 8, for convenience, the normal direction of the planar element configuring the antenna element is a z direction, and directions horizontal to the plane of the element and orthogonal to each other are an x direction and a y direction.

First, an example of a simulation result of a radiation pattern of the antenna element in a case where the number of antenna elements is one will be described with reference to FIGS. 5 and 6.

Figure 5:
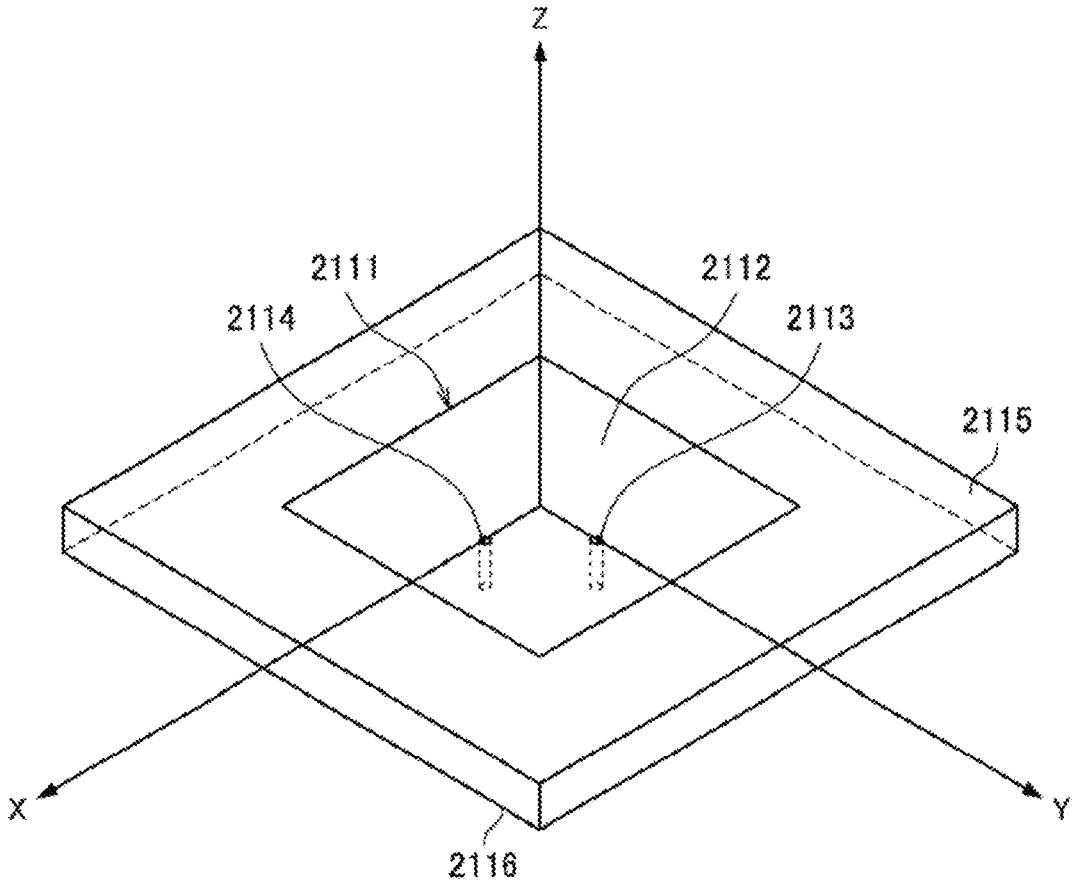
FIG. 5 is an explanatory view for describing an example of distortion of a radiation pattern caused by arraying a plurality of antenna elements.

For example, FIG. 5 illustrates an example of a schematic configuration of a single antenna element configured as a patch antenna, which can be applied to the antenna device according to the present embodiment. As illustrated in FIG. 5, the antenna element 2111 configured as a patch antenna is provided with feeding points 2113 and 2114 in the planar element 2112. Specifically, the element 2112 is provided on one surface of a substantially planar dielectric substrate 2115 containing a dielectric. Furthermore, a substantially planar ground plate 2116 is provided on the other surface of the dielectric substrate 2115, that is, on a surface opposite to the surface where the element 2112 is provided, so as to cover substantially the entire surface. Furthermore, each of the feeding points 2113 and 2114 is provided to penetrate the dielectric substrate 2115 along the normal direction of the element 2112 and to electrically connect the element 2112 and the ground plate 2116.

Figure 6:
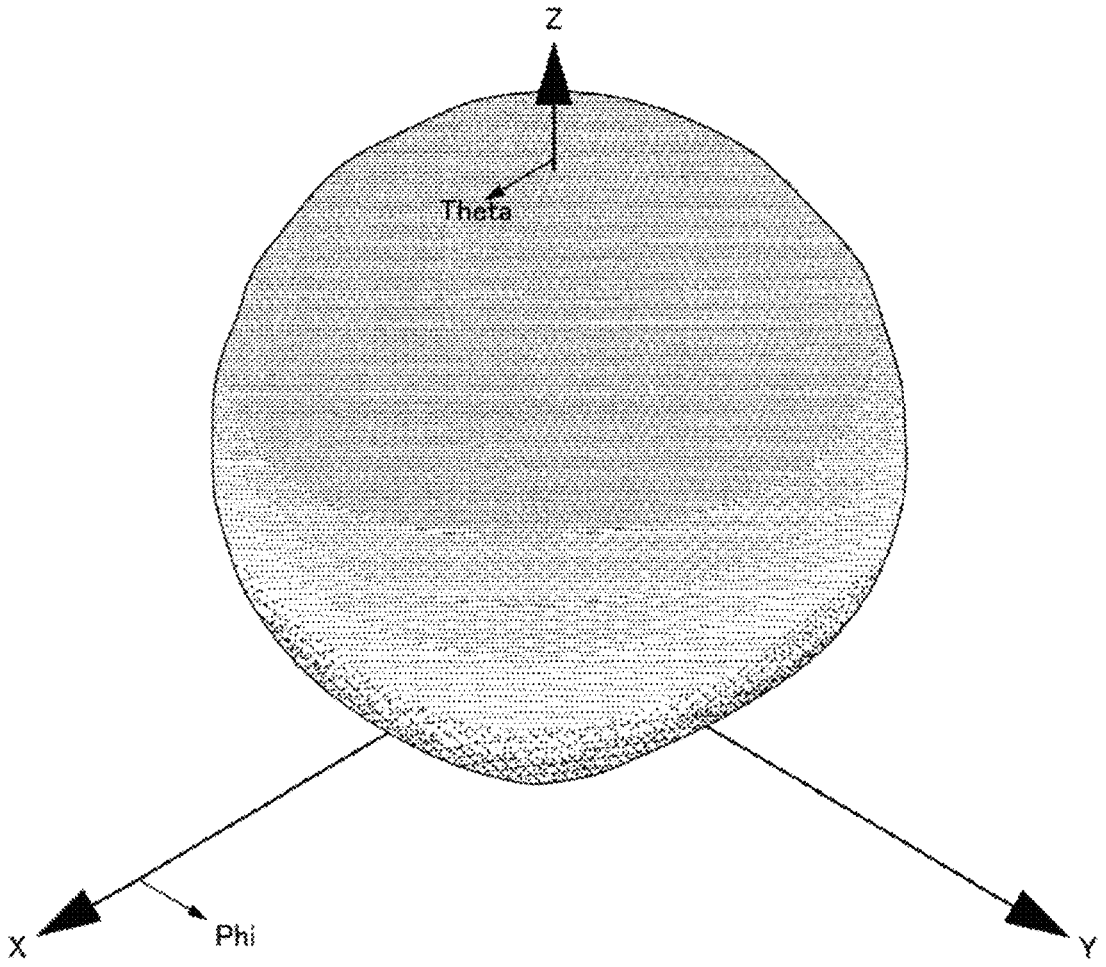
FIG. 6 is an explanatory diagram for describing an example of distortion of a radiation pattern caused by arraying a plurality of antenna elements.

Furthermore, FIG. 6 illustrates an example of a simulation result of a radiation pattern according to a radiation characteristic of the antenna element 2111 described with reference to FIG. 5. As illustrated in FIG. 6, in a case where the antenna element 2111 is used alone, a radiation pattern with less distortion (ideally without distortion) is formed.

Next, an example of a simulation result of a radiation pattern of the antenna elements 2111 in the case of arraying the antenna elements 2111 illustrated in FIG. 5 will be described with reference to FIGS. 7 and 8.

Figure 7:
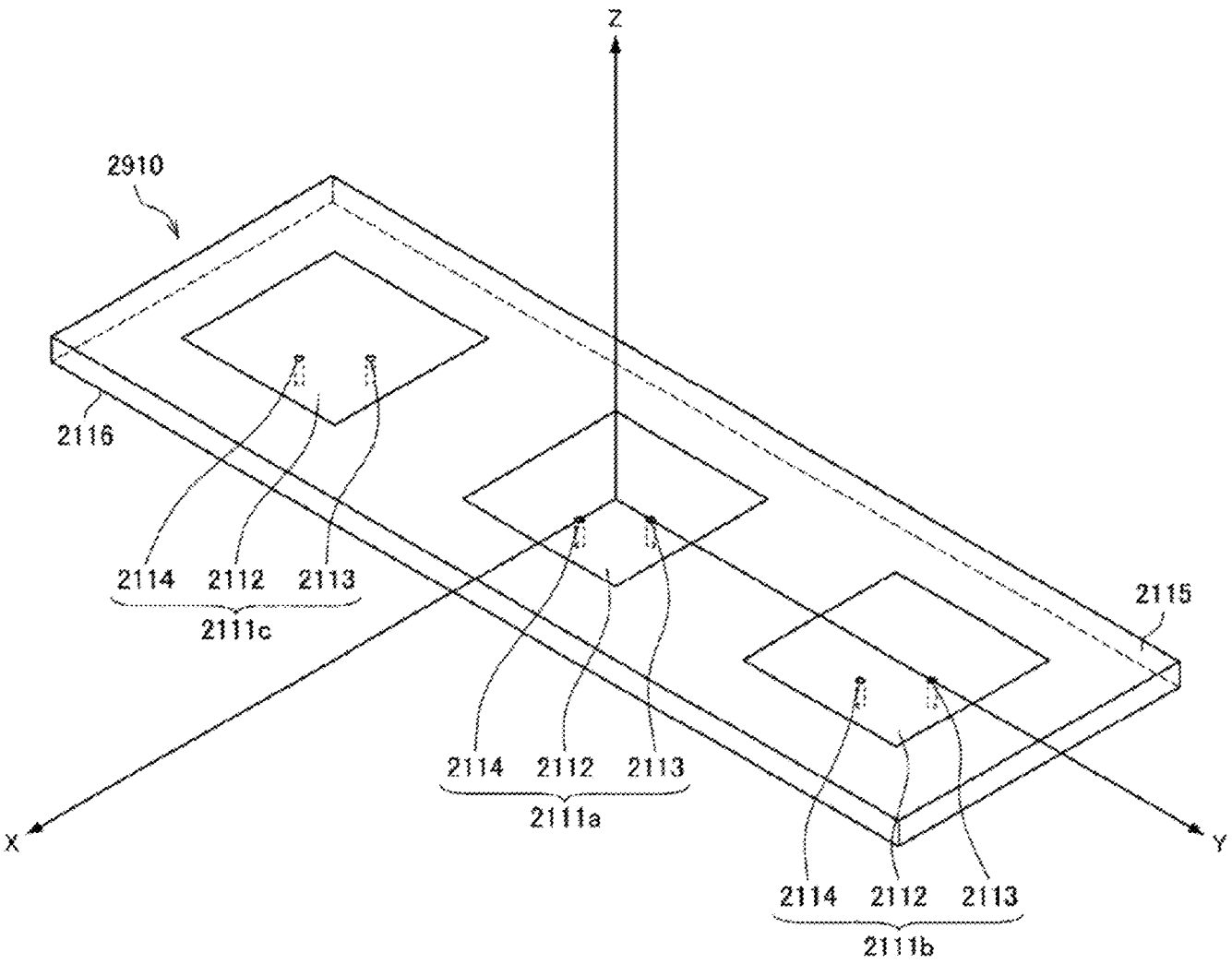
FIG. 7 is an explanatory view for describing an example of distortion of a radiation pattern caused by arraying a plurality of antenna elements.

For example, FIG. 7 illustrates an example of a schematic configuration of an antenna device 2910 configured as a patch array antenna, where a plurality of the antenna elements 2111 illustrated in FIG. 5 is provided. As illustrated in FIG. 7, the antenna device 2910 is configured such that three antenna elements 2111 are disposed on one surface of the dielectric substrate 2115 along a predetermined direction (y direction). Note that, in the present description, for convenience, the antenna element 2111 disposed in the center is referred to as an "antenna element 2111*a*" and the other two antenna elements 2111 are referred to as "antenna element 2111*b*" and "antenna element 2111*c*", among the three antenna elements 2111 disposed in the y direction. Furthermore, the substantially planar ground plate 2116 is provided on the other surface of the dielectric substrate 2115 so as to cover substantially the entire surface. Each of the feeding points 2113 and 2114 of the antenna elements 2111*a* to 2111*c* is provided to penetrate the dielectric substrate 2115 along the normal direction of the corresponding element 2112 and to electrically connect the corresponding element 2112 and the ground plate 2116.

Figure 8:
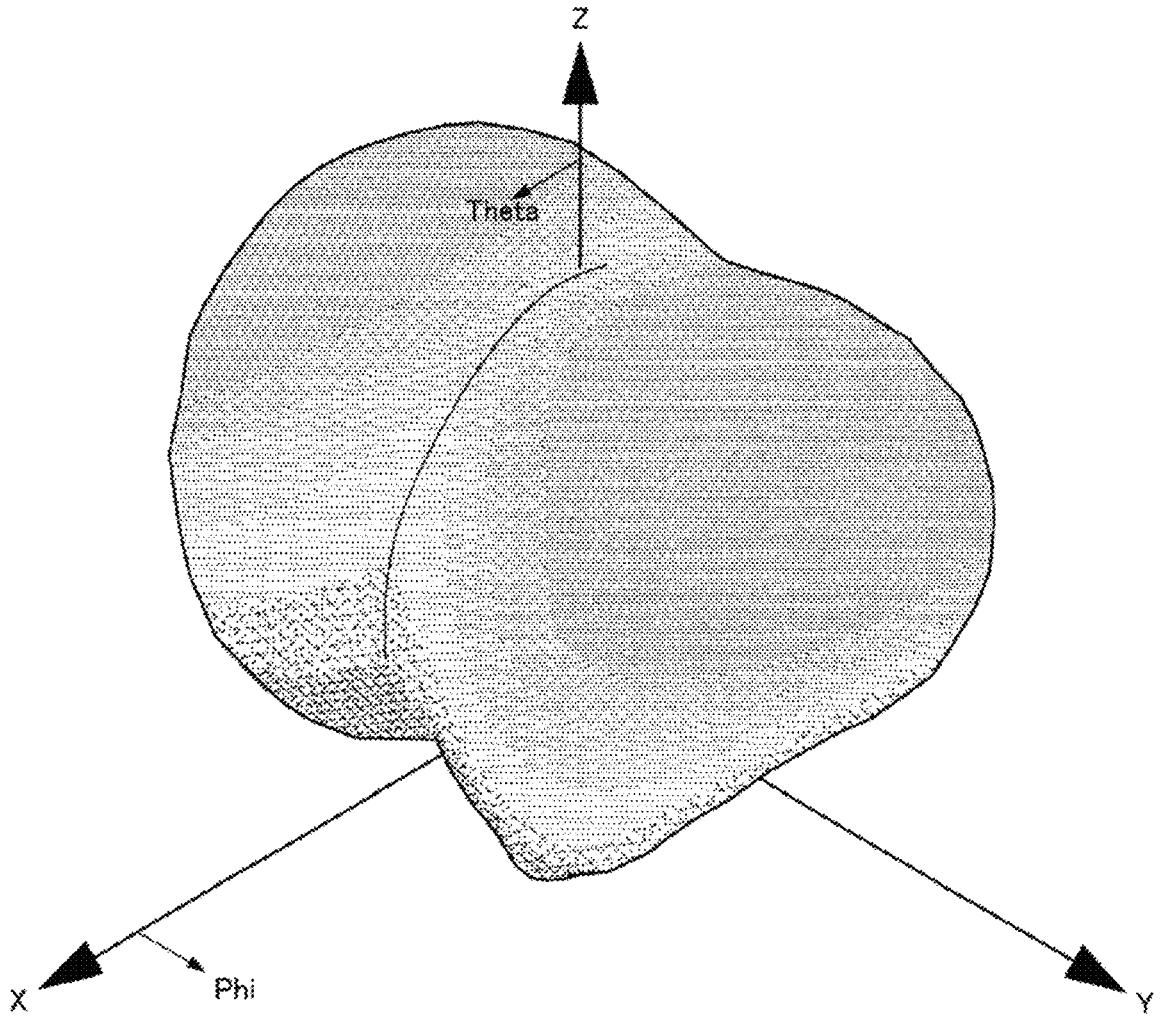
FIG. 8 is an explanatory diagram for describing an example of distortion of a radiation pattern caused by arraying a plurality of antenna elements.

Furthermore, FIG. 8 illustrates an example of a simulation result of a radiation pattern according to a radiation characteristic of the antenna element 2111*a* in the antenna device 2910 described with reference to FIG. 7. As can be seen from a comparison between FIG. 8 and FIG. 6, a distortion has occurred in the radiation pattern of at least a part of the antenna elements 2111 (for example, the antenna element 2111*a*) by arraying the antenna elements 2111*a* to 2111*c* in the y direction (that is, beam splitting has occurred in the ±y directions) in the example illustrated in FIG. 8. As described above, when a distortion occurs in the radiation pattern, there are some cases where obtainment of a desired gain in at least a part of a predetermined space is difficult in transmitting or receiving a wireless signal via the antenna element 2111*a*, for example.

In view of the foregoing, the present disclosure proposes an example of a technology capable of obtaining a more favorable radiation pattern even in a case of arraying a plurality of antenna elements.

3. TECHNICAL CHARACTERISTICS

Hereinafter, technical characteristics of the communication device according to an embodiment of the present disclosure will be described.

3.1. Configuration

First, a basic configuration of the antenna device according to the present embodiment will be described focusing on a configuration for suppressing the distortion of the radiation pattern for at least some of the plurality of antenna elements in the case of arraying the antenna elements.

Figure 9:
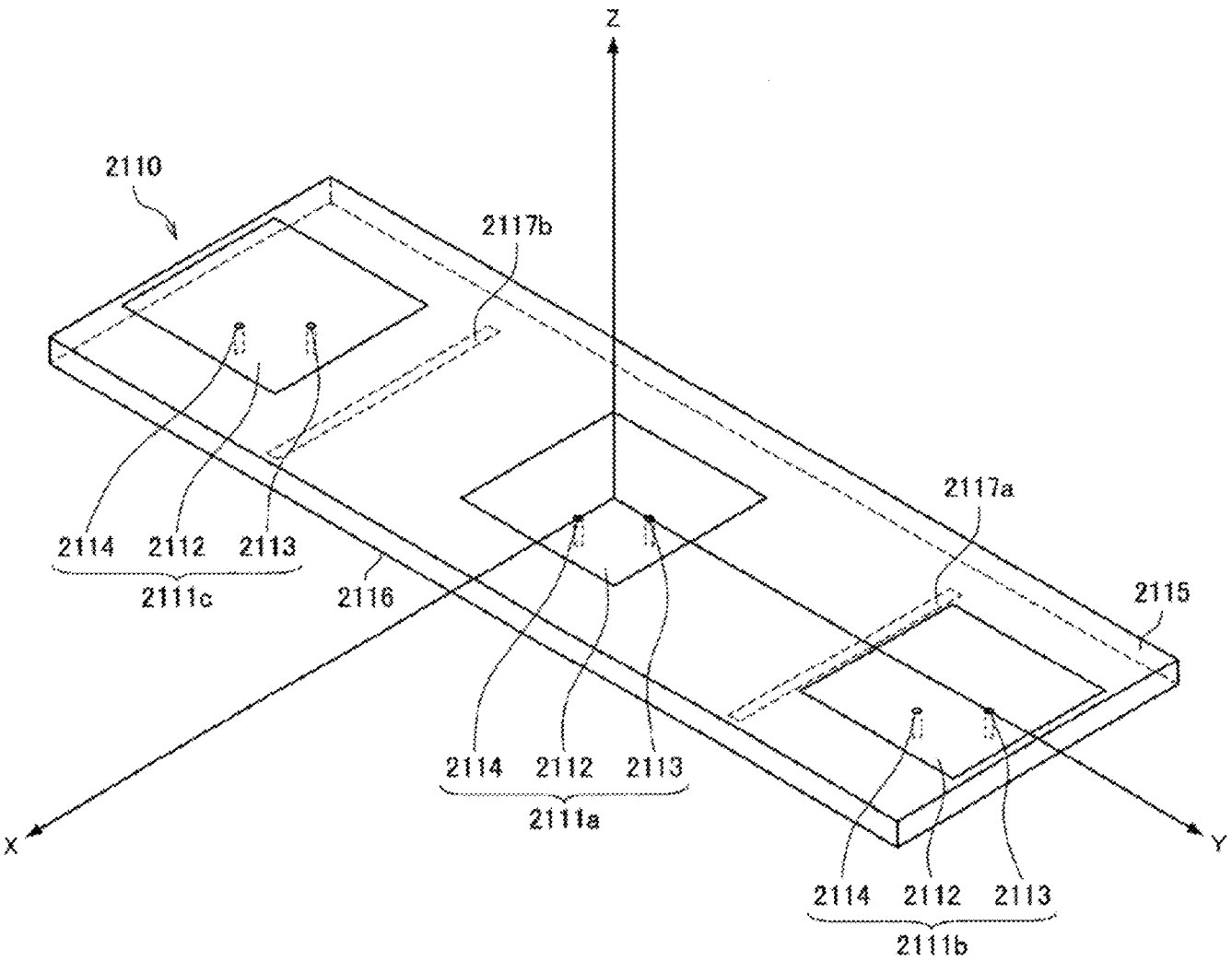
FIG. 9 is an explanatory view for describing a schematic configuration of the antenna device according to the embodiment.

First, an outline of the basic configuration of the antenna device according to the present embodiment will be described with reference to FIG. 9. FIG. 9 is an explanatory view for describing a schematic configuration of the antenna device according to the present embodiment, illustrating an example of a configuration of the patch array antenna in which the patch antennas are arrayed. Note that, in the example illustrated in FIG. 9, for convenience, the normal direction of the planar element configuring the antenna element is defined as the z direction, and the directions horizontal to the plane of the element and orthogonal to each other are defined as the x direction and the y direction, similarly to the example illustrated in FIG. 7. Furthermore, in the example illustrated in FIG. 9, the antenna elements 2111*c*, 2111*a*, and 2111*b* are disposed in this order on one surface of the dielectric substrate 2115 along the y direction, similarly to the example described with reference to FIG. 7.

As illustrated in FIG. 9, the antenna device 2110 according to the present embodiment is different from the antenna device 2910 described with reference to FIG. 7 in that slots 2117*a* and 2117*b* are provided in the ground plate 2116.

Figure 10:
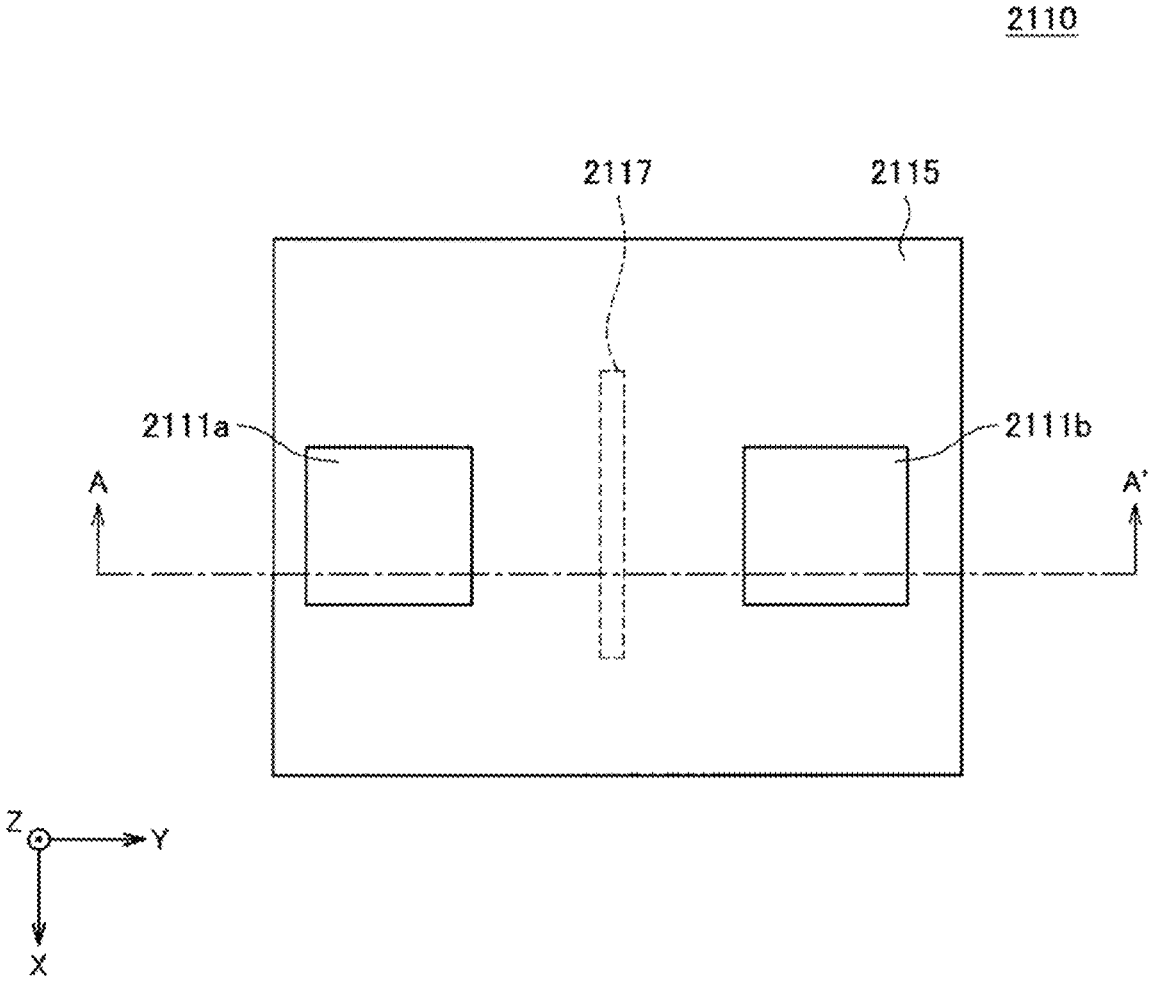
FIG. 10 is a schematic plan view of the antenna device according to the embodiment.
Figure 11:
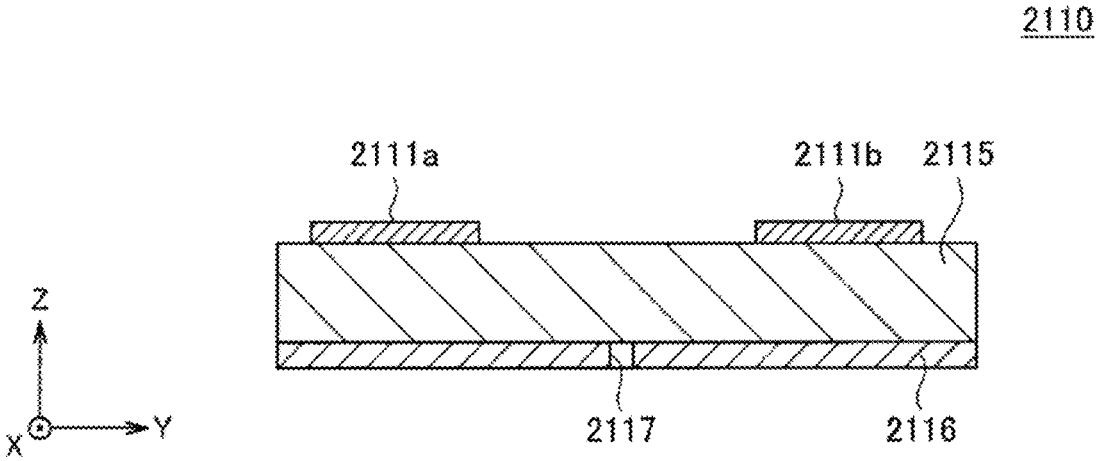
FIG. 11 is a schematic A-A' cross-sectional view of the antenna device illustrated in FIG. 10.

Here, a characteristic configuration of the antenna device 2110 according to the present embodiment will be described particularly focusing on a configuration of a portion where the antenna elements 2111*a* and 2111*b* are disposed illustrated in FIG. 9, with reference to FIGS. 10 and 11. FIG. 10 is a schematic plan view of the antenna device 2110 according to the present embodiment, illustrating an example of a schematic configuration of the portion where the antenna elements 2111*a* and 2111*b* are disposed, in a case of viewing the antenna device 2110 from above (z direction). Furthermore, FIG. 11 is a schematic A-A' cross-sectional view of the antenna device 2110 illustrated in FIG. 10. Note that, in FIGS. 10 and 11, illustration of the feeding points 2113 and 2114 of the antenna elements 2111*a* and 2111*b* is omitted.

As illustrated in FIGS. 10 and 11, in the antenna device 2110 according to the present embodiment, the slot 2117 is provided in a region in the ground plate 2116, the region corresponding to a region between the two antenna elements 2111 next to each other (for example, the antenna elements 2111*a* and 2111*b*). The slot 2117 is formed in a long shape to extend in the direction (x direction) orthogonal to the direction (y direction) in which the two antenna elements 2111 are arrayed. Note that, hereinafter, the direction in which the plurality of antenna elements 2111 is arrayed is also referred to as an "array direction". Furthermore, details of the position where the slot 2117 is provided, the size of the slot 2117, and the like will be separately described below. Furthermore, the slot 2117 illustrated in FIGS. 10 and 11 corresponds to, for example, the slot 2117*a* in the example illustrated in FIG. 9.

Note that the array direction of the plurality of antenna elements 2111 corresponds to an example of a "first direction", and the direction orthogonal to the array direction (that is, the direction in which the slot 2117 extends) corresponds to an example of a "second direction". Furthermore, a signal having a polarization direction substantially coincident with the first direction corresponds to an example of a "first wireless signal", and a signal having a polarization direction substantially coincident with the second direction corresponds to an example of a "second wireless signal", of a plurality of polarized waves having different polarization directions from each other transmitted or received by the antenna element 2111.

Furthermore, the example illustrated in FIGS. 10 and 11 focuses on the portion where the antenna elements 2111*a* and 2111*b* are disposed. However, a similar configuration is applied to a portion where the antenna elements 2111*a* and 2111*c* are disposed. That is, in the example illustrated in FIGS. 10 and 11, a configuration in which the antenna element 2111*b* is replaced with the antenna element 2111*c* is substantially equal to the configuration of the portion where the antenna elements 2111*a* and 2111*c* are provided in the antenna device 2110. Furthermore, the slot 2117 in this case corresponds to, for example, the slot 2117*b* in the example illustrated in FIG. 9.

Figure 12:
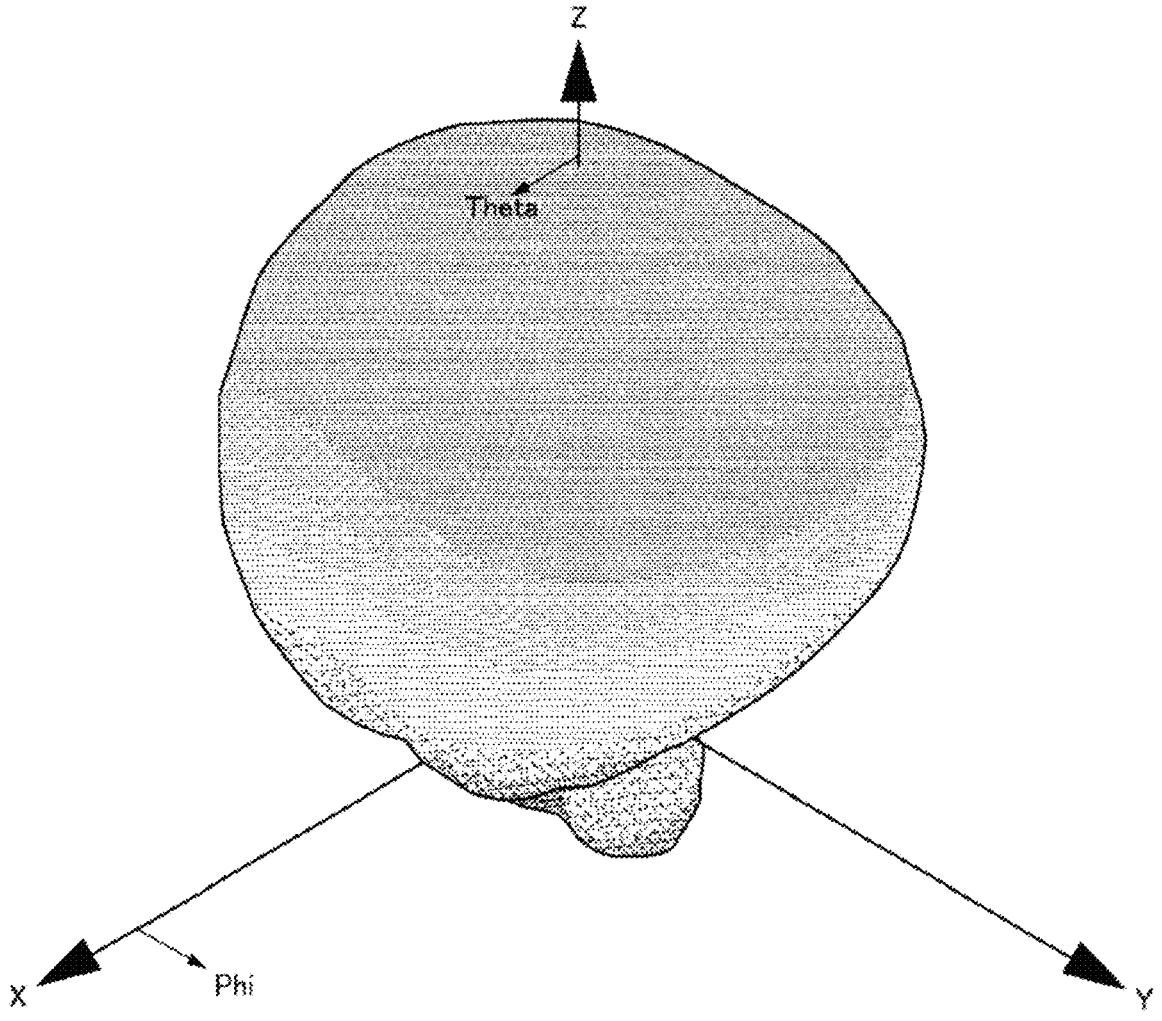
FIG. 12 is an explanatory diagram for describing a radiation pattern of the antenna device according to the embodiment.

Next, the radiation pattern of the antenna element 2111*a* in the antenna device 2110 described with reference to FIG. 9 will be described. For example, FIG. 12 is an explanatory diagram for describing the radiation pattern of the antenna device according to the present embodiment, illustrating an example of a simulation result of the radiation pattern according to the radiation characteristic of the antenna element 2111*a* in the antenna device 2110 described with reference to FIG. 9. As can be seen from a comparison of FIG. 12 with FIG. 8, the distortion of the radiation pattern caused in the antenna device 2910 illustrated in FIG. 7 has been improved in the antenna device 2110 according to the present embodiment. That is, the antenna device 2110 according to the present embodiment improves the distortion (that is, the beam split in the ±y directions illustrated in FIG. 8) of the radiation pattern caused by arraying the antenna element 2111, and can further approach the radiation pattern (illustrated in FIG. 6) in the case of the single antenna element 2111.

Figure 13:
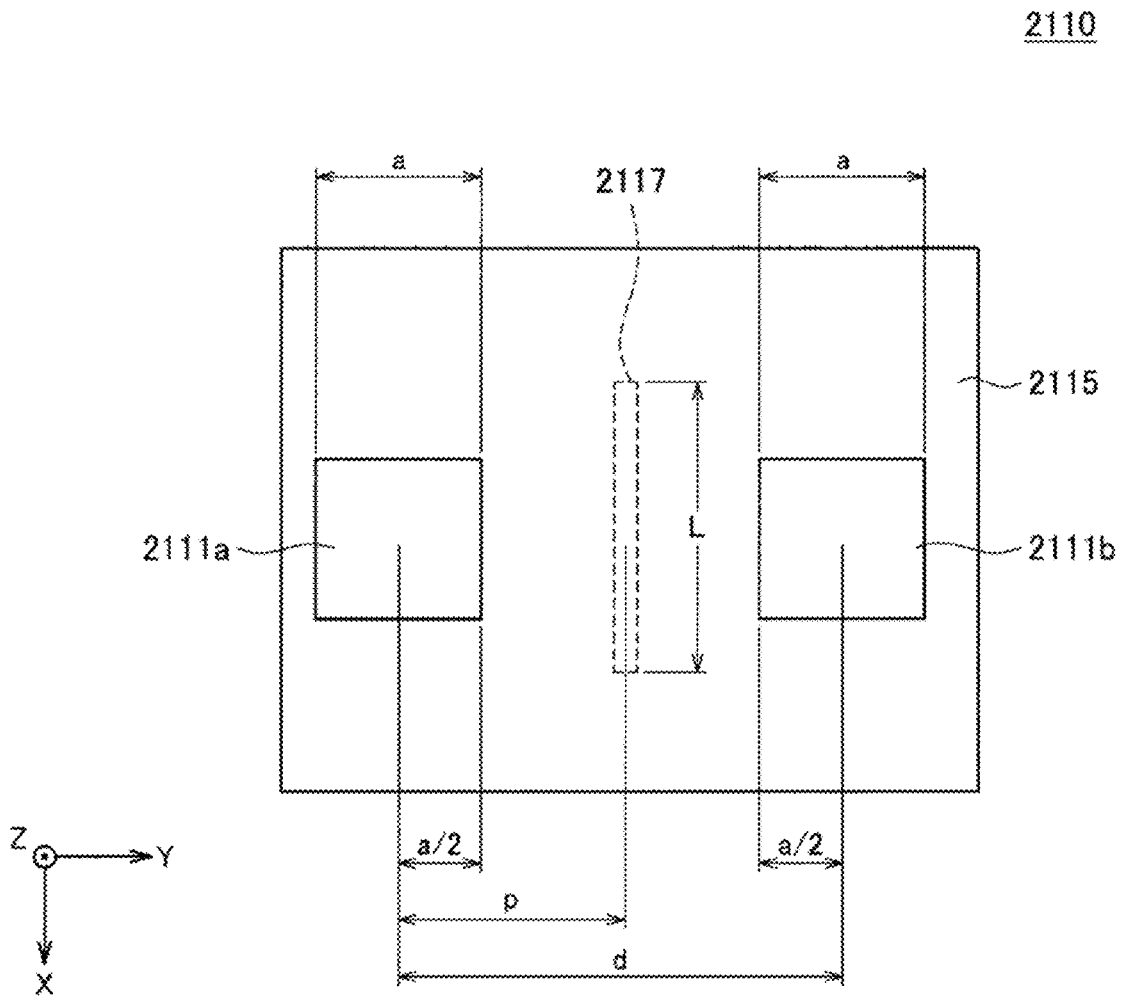
FIG. 13 is an explanatory view for describing an example of a configuration of the antenna device according to the embodiment.

Next, details of the position where the slot 2117 is provided and the size of the slot 2117 will be described with reference to FIG. 13. FIG. 13 is an explanatory view for describing an example of the configuration of the antenna device according to the present embodiment. FIG. 13 illustrates an example of a schematic configuration of the portion where the antenna elements 2111*a* and 2111*b* are disposed, in the case of viewing the antenna device 2110 from above (z direction), similarly to FIG. 10. Note that the present description will be given on the assumption that the antenna element 2111*a* corresponds to an antenna element (hereinafter simply referred to as "antenna element to be improved") that is to be mainly improved in distortion of the radiation pattern. Note that the antenna element 2111*a* to be improved corresponds to an example of a "first antenna element", and the antenna element 2111*b* located next to the antenna element 2111*a* corresponds to an example of a "second antenna element".

In FIG. 13, the reference symbol a denotes a width in the array direction (the y direction in FIG. 13) of the plurality of antenna elements 2111, among widths of the end portions of the antenna element 2111. Furthermore, the reference symbol d denotes a distance between respective centers of the two antenna elements 2111 next to each other (a distance in the y direction in FIG. 13). Note that, in the following description, the distance d is also referred to as "element interval d". Furthermore, the reference symbol L denotes a slot length of the slot 2117. More specifically, the slot length L corresponds to a width in the longitudinal direction of the slot 2117, that is, a width in the direction (the x direction in FIG. 13) orthogonal to the array direction of the plurality of antenna elements 2111. Furthermore, the reference symbol p denotes a distance between the center of the first antenna element 2111 (that is, the antenna element 2111*a*), of the two antenna elements 2111 next to each other, and the center in the array direction of the slot 2117 (that is, a distance in the array direction). That is, the distance p denotes a position (a position in the y direction in FIG. 13) where the slot 2117 is provided with reference to the first antenna element 2111. Note that, in the following description, the position where the slot 2117 is provided is also referred to as "slot position".

Furthermore, in the present description, a relative dielectric constant of the dielectric configuring the dielectric substrate 2115 is $\varepsilon_{r1}$. Furthermore, a relative dielectric constant of the dielectric located on the opposite side of the dielectric substrate 2115 with respect to the ground plate 2116 is $\varepsilon_{r2}$. Note that, in a case where the dielectric located on a surface side opposite to the surface where the dielectric substrate 2115 is provided in the ground plate 2116 is the air (for example, in a case where no other substrate and the like are provided), the relative dielectric constant $\varepsilon_{r2}=1.0$. Furthermore, a wavelength in a free space of the wireless signal transmitted or received by the antenna element 2111 is $\lambda_0$, and a resonance wavelength of the slot is $\lambda_g$.

(Slot Length)

First, conditions of the slot length L of the slot 2117 in the antenna device 2110 according to the present embodiment will be described. In the antenna device 2110 according to the present embodiment, the antenna element 2111 (in particular, the first antenna element 2111) and the slot 2117 are coupled to reduce a current flowing through the ground plate 2116 (ground plane current), resulting in suppression of (decrease in) the distortion of the radiation pattern of the antenna element 2111.

Here, to couple the antenna element 2111 and the slot 2117, the slot length L of the slot 2117 needs to be not less than ½ of the resonance wavelength $\lambda_g$. Furthermore, the resonance wavelength $\lambda_g$ is calculated from the wavelength $\lambda_0$ of the wireless signal transmitted or received by the antenna element 2111 and an average of the relative dielectric constants of the space surrounding the slot 2117.

That is, in the antenna device 2110 according to the present embodiment, the slot 2117 is formed such that the slot length L satisfies the conditions expressed by (Expression 1) and (Expression 2) below.

[Math 2]

$$L > \frac{\lambda_g}{2} \quad \text{(Expression 1)}$$

$$\lambda_g = \frac{\lambda_0}{\sqrt{(\varepsilon_{r1} + \varepsilon_{r2})/2}} \quad \text{(Expression 2)}$$

(Element Interval)

Next, conditions of the element interval d of the two antenna elements 2111 next to each other in the antenna device 2110 according to the present embodiment will be described. The element interval d is desirably set such that the two antenna elements 2111 next to each other are separated as much as possible from the viewpoint of further reduction of the distortion of the radiation pattern.

Figure 14:
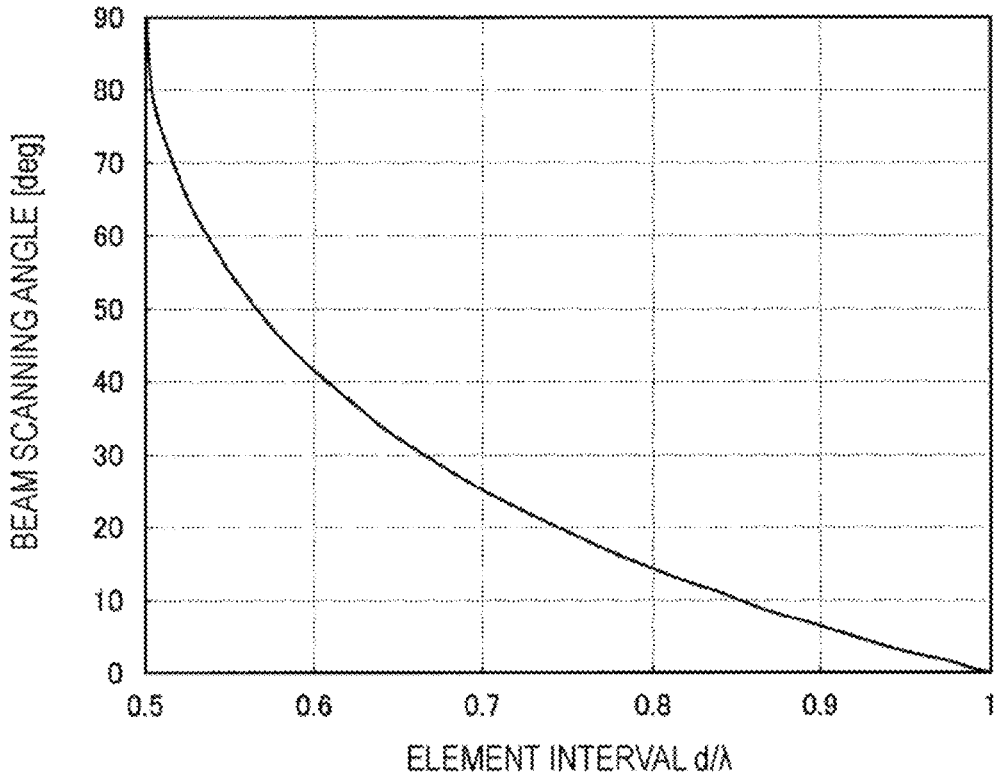
FIG. 14 is a graph illustrating an example of a relationship between an antenna element interval and a beam scanning angle at which a grating lobe appears in a visible region.

Meanwhile, when $d \geq \lambda_0$, there are some cases where unnecessary radiation called grating lobe occurs and the gain decreases in a predetermined direction in a case where the antenna device is operated as an array antenna. The element interval d where the grating lobe occurs depends on a required beam scanning angle in a range of $\lambda_0/2 < d < \lambda_0$. For example, FIG. 14 is a graph illustrating an example of a relationship between the antenna element interval and the beam scanning angle at which the grating lobe appears in a visible region. In FIG. 14, the horizontal axis represents the element interval in terms of $d/\lambda$ ($\lambda$ is the wavelength of the wireless signal), and the vertical axis represents the beam scanning angle.

In view of the above conditions, in the antenna device 2110 according to the present embodiment, it is more desirable to dispose the antenna elements 2111 such that the element interval d satisfies the condition expressed by (Expression 3) below.

[Math 3]

$$\frac{\lambda_0}{2} \leq d < \lambda_0 \quad \text{(Expression 3)}$$

(Slot Position)

Next, conditions of the position of the slot 2117 with reference to the first antenna element 2111 (that is, the antenna element 2111 to be improved), that is, the distance p between the center of the antenna element 2111 and the center in the array direction of the slot 2117, in the antenna device 2110 according to the present embodiment will be described.

The performance of the antenna element 2111 tends to further decrease as the slot 2117 is located closer to the antenna element 2111. Meanwhile, the influence on the decrease in performance of the antenna element 2111 becomes smaller as the slot 2117 is provided at a position separated in some degree from an end portion of the antenna element 2111. That is, a minimum value of the distance p is desirably set to a distance of a case where the slot 2117 is located at a position immediately before reaching an edge of the first antenna element 2111, of the two antenna elements 2111 next to each other. Furthermore, a maximum value of the distance p is desirably set to a distance of a case where the slot 2117 is located at a position immediately before reaching an edge of the second antenna element 2111 located next to the first antenna element 2111.

Since a width a of one side of the antenna element 2111 satisfies the condition expressed as (Expression 4) below on the basis of the above conditions, the distance p is desirably set to satisfy the condition expressed as (Expression 5) below in view of the above-described condition expressed as (Expression 3).

[Math 4]

$$a < \frac{\lambda_0}{2\sqrt{\varepsilon_{r1}}} \quad \text{(Expression 4)}$$

$$\frac{a}{2} \leq p < d - \frac{a}{2} \quad \text{(Expression 5)}$$

That is, in the antenna device 2110 according to the present embodiment, it is more desirable to provide the slot 2117 such that the distance p satisfies the condition expressed by (Expression 6) below, on the basis of the conditional expressions expressed by (Expression 3) to (Expression 5) above.

[Math 5]

$$\frac{\lambda_0}{4\sqrt{\varepsilon_{r1}}} < p < d - \frac{\lambda_0}{4\sqrt{\varepsilon_{r1}}} \quad \text{(Expression 6)}$$

As described above, a basic configuration of the antenna device according to the present embodiment has been described focusing on the configuration for suppressing the distortion of the radiation pattern for at least some of the plurality of antenna elements in the case of arraying the antenna elements, with reference to FIGS. 9 to 14.

Note that the configuration of the antenna device according to the above-described present embodiment is merely an example, and the configuration of each unit of the antenna device is not necessarily limited to only the above-described example as long as the above-described conditions are satisfied. As a specific example, the number of antenna elements provided in the antenna device is not particularly limited as long as the number is two or larger.

3.2. Modification

Next, modifications of the antenna device according to the present embodiment will be described.

(Modification 1: Example of Orientation of Antenna Element)

Figure 15:
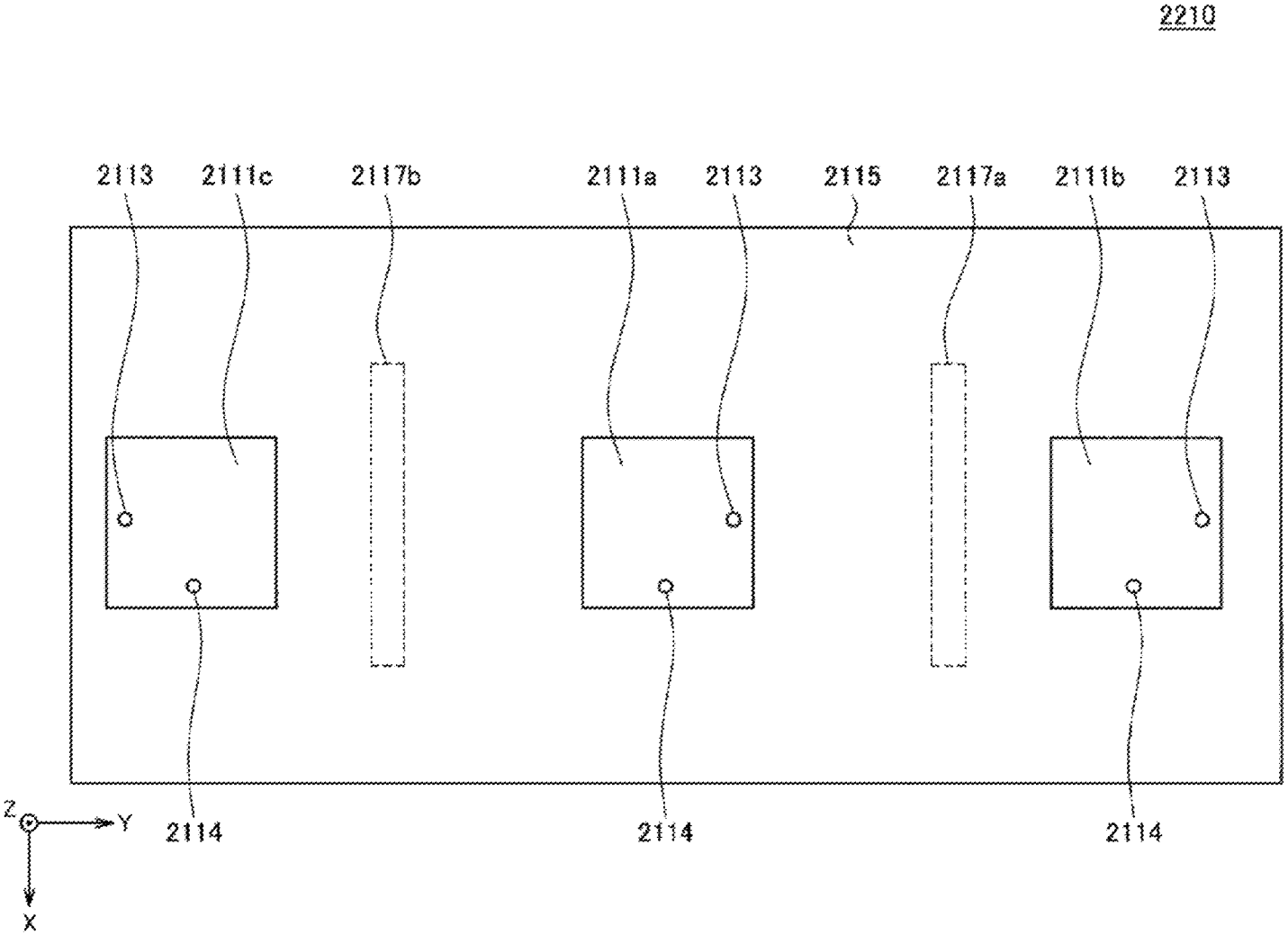
FIG. 15 is an explanatory view for describing an example of a configuration of an antenna device according to Modification 1.

First, as Modification 1, an example of an orientation in which the second antenna element 2111 located next to the first antenna element 2111 (that is, the antenna element to be improved) is installed will be described. For example, FIG. 15 is an explanatory view for describing an example of a configuration of an antenna device according to Modification 1. Note that, in the example illustrated in FIG. 15, the normal direction of the planar element configuring the antenna element provided in the antenna device is defined as the z direction, and the directions horizontal to the plane of the element and orthogonal to each other are defined as the x direction and the y direction. That is, FIG. 15 is a schematic plan view of the antenna device according to Modification 1, illustrating an example of a schematic configuration of the antenna device in a case of viewing the antenna device from above (z direction). Note that, in the following description, the antenna device according to Modification 1 may be referred to as an "antenna device 2210" in order to be distinguished from the antenna devices according to the above-described embodiment and other modifications and examples.

As illustrated in FIG. 15, the antenna device 2210 according to Modification 1 has antenna elements 2111*c*, 2111*a*, and 2111*b* arranged in this order along a y direction. Furthermore, slots 2117*a* and 2117*b* are provided in a ground plate 2116. Specifically, the slot 2117*a* is provided in a region in the ground plate 2116, the region corresponding to a region between the antenna elements 2111*a* and 2111*b*, and the slot 2117*b* is provided in a region in the ground plate 2116, the region corresponding to a region between the antenna elements 2111*a* and 2111*c*. That is, regarding the above configuration, the antenna device 2210 has a similar configuration to the antenna device 2110 described with reference to FIG. 9.

Meanwhile, the antenna device 2210 according to Modification 1 is different from the antenna device 2110 described with reference to FIG. 9 in that the orientation of the second antenna element 2111 located next to the first antenna element 2111 is determined according to a predetermined condition.

Specifically, in the example illustrated in FIG. 15, the antenna element 2111*a* corresponds to the "first antenna element", and the antenna elements 2111*b* and 2111*c* located next to the first antenna element corresponds to the "second antenna element". In this case, for the antenna elements 2111*b* and 2111*c* according to Modification 1, the feeding point 2113 corresponding to the wireless signal having the polarization direction substantially coincident with the y direction in FIG. 15 is eccentrically provided in the direction of the end portion on the opposite side of the antenna element 2111*a*, of the end portions in the y direction (that is, the array direction) of the antenna element 2111 (element 2112). Specifically, the feeding point 2113 of the antenna element 2111*b* is eccentrically provided in the direction of the end portion (that is, the end portion in the +y direction) on the opposite side of the antenna element 2111*a*. Furthermore, the feeding point 2113 of the antenna element 2111*c* is eccentrically provided in the direction of the end portion (that is, the end portion in the −y direction) on the opposite side of the antenna element 2111*a*. As described above, in the antenna device according to Modification 1, the feeding point corresponding to the wireless signal having the polarization direction substantially coincident with the array direction of the plurality of antenna elements of the second antenna element is eccentrically provided in the direction of the end portion on the opposite side of the first antenna element, of the end portions in the array direction in the antenna element. Note that the feeding point 2113 corresponds to an example of a "first feeding point", and the feeding point 2114 corresponds to an example of a "second feeding point".

With the above configuration, the feeding points 2113 of the antenna elements 2111*b* and 2111*c* are provided at the positions physically separated from the antenna element 2111*a*. This further reduces the possibility of coupling each of the antenna elements 2111*b* and 2111*c* and the antenna element 2111*a* when feeding power to the feeding point 2113 of each of the antenna elements 2111*b* and 2111*c*. In other words, according to the antenna device according to Modification 1, the influence on the first antenna element due to the power feeding to the second antenna element can be more decreased.

As Modification 1, an example of the orientation in which the second antenna element 2111 located next to the first antenna element 2111 is installed has been described with reference to FIG. 15.

3.3. Example

Next, examples of the antenna device according to the present embodiment will be described.

Example 1: Four-Element Array Configuration

Figure 16:
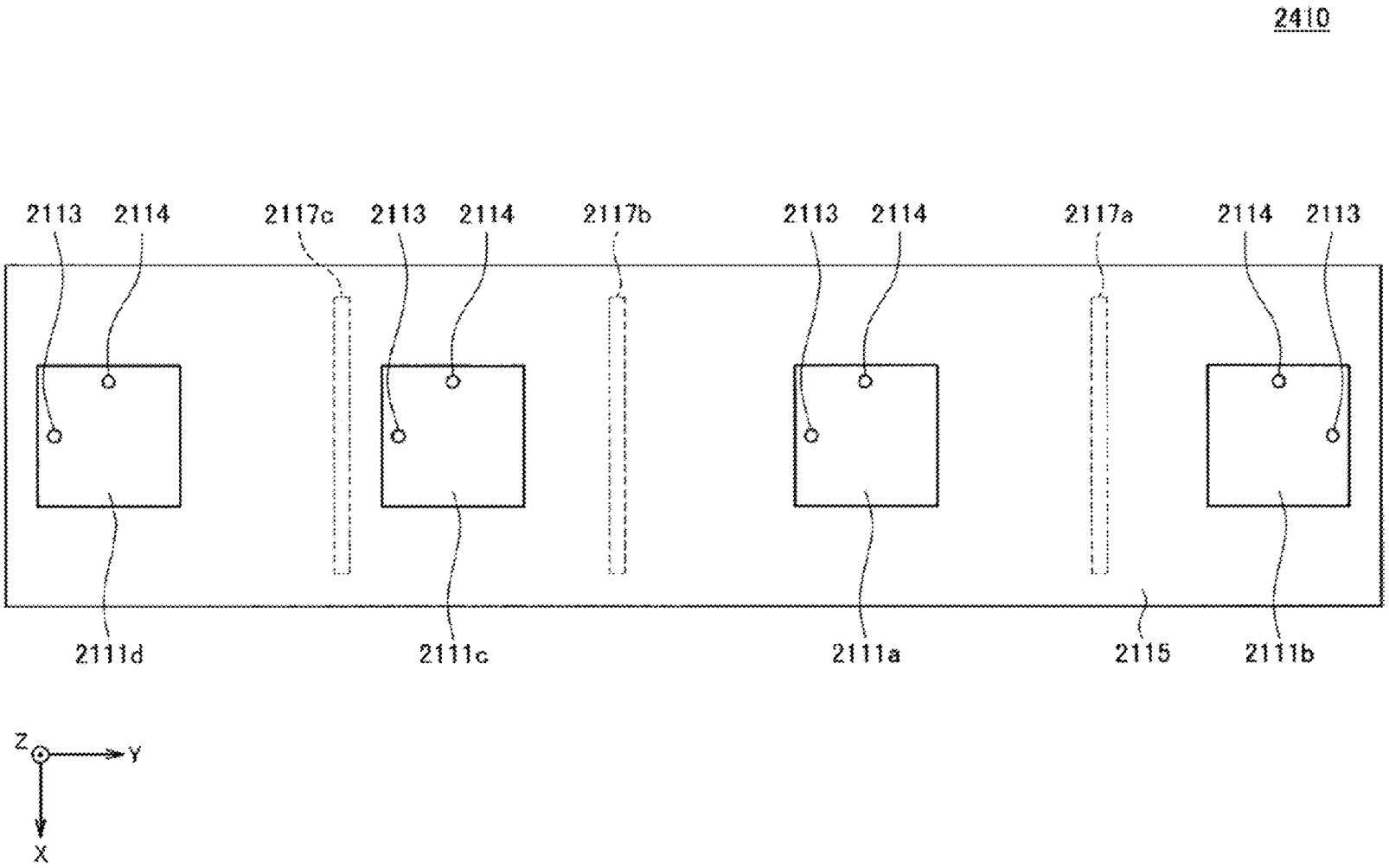
FIG. 16 is an explanatory view for describing an example of a configuration of an antenna device according to Example 1.

First, as Example 1, an example of a case of configuring the antenna device according to the present embodiment by arraying four antenna elements will be described. For example, FIG. 16 is an explanatory view for describing an example of a configuration of the antenna device according to Example 1. Note that, in the example illustrated in FIG. 16, the normal direction of the planar element configuring the antenna element provided in the antenna device is defined as the z direction, and the directions horizontal to the plane of the element and orthogonal to each other are defined as the x direction and the y direction. That is, FIG. 16 is a schematic plan view of the antenna device according to Example 1, illustrating an example of a schematic configuration of the antenna device in a case of viewing the antenna device from above (z direction). Note that, in the following description, the antenna device according to Example 1 may be referred to as an "antenna device 2410" in order to be distinguished from the antenna devices according to the above-described embodiment and other modifications and examples.

As illustrated in FIG. 16, the antenna device 2410 according to Example 1 has antenna elements 2111*d*, 2111*c*, 2111*a*, and 2111*b* disposed in this order along the y direction. Note that the antenna element 2111*a* corresponds to an example of the first antenna element (that is, the antenna element to be improved), and the antenna elements 2111*b* and 2111*c* located next to the antenna element 2111*a* correspond to the "second antenna elements", among the antenna elements 2111*a* to 2111*d*. Furthermore, in the following description, the antenna element 2111 corresponding to none of the first antenna element and the second antenna element (for example, the antenna element 2111*d* illustrated in FIG. 16) is also referred to as a "third antenna element", among the plurality of antenna elements 2111.

Furthermore, the slots 2117*a* and 2117*b* are provided in the ground plate 2116. Specifically, the slot 2117*a* is provided in a region in the ground plate 2116, the region corresponding to a region between the antenna element 2111*a* (first antenna element) and the antenna element 2111*b* (second antenna element). Furthermore, the slot 2117*b* is provided in a region in the ground plate 2116, the region corresponding to a region between the antenna element 2111*a* (first antenna element) and the antenna element 2111*c* (second antenna element). Note that a slot 2117*c* may be provided in a region in the ground plate 2116, the region corresponding to a region between the antenna element 2111*c* (second antenna element) and the antenna element 2111*d* (third antenna element). Furthermore, as another example, the slot 2117*c* may not be provided in the ground plate 2116.

Furthermore, as described as Modification 1, for the antenna elements 2111*b* and 2111*c* (that is, the second antenna elements), the feeding point 2113 may be eccentrically provided in the direction of the end portion on the opposite side of the antenna element 2111*a* (that is, the first antenna element), of the end portions in the y direction (that is, the array direction) of the antenna element 2111 (element 2112). For example, in the example illustrated in FIG. 16, the feeding point 2113 of the antenna element 2111*b* is eccentrically provided in the direction of the end portion (that is, the end portion in the +y direction) on the opposite side of the antenna element 2111*a*. Furthermore, the feeding point 2113 of the antenna element 2111*c* is eccentrically provided in the direction of the end portion (that is, the end portion in the −y direction) on the opposite side of the antenna element 2111*a*.

With the above configuration, according to the antenna device 2410 of Example 1, the distortion of the radiation pattern of at least the antenna element 2111*a* (that is, the first antenna element) among the antenna elements 2111*a* to 2111*d*, can be suppressed (reduced) in a more favorable manner.

As Example 1, an example of a case of configuring the antenna device according to the present embodiment by arraying the four antenna elements has been described with reference to FIG. 16.

Example 2: L-Shaped Antenna Device

Figure 17:
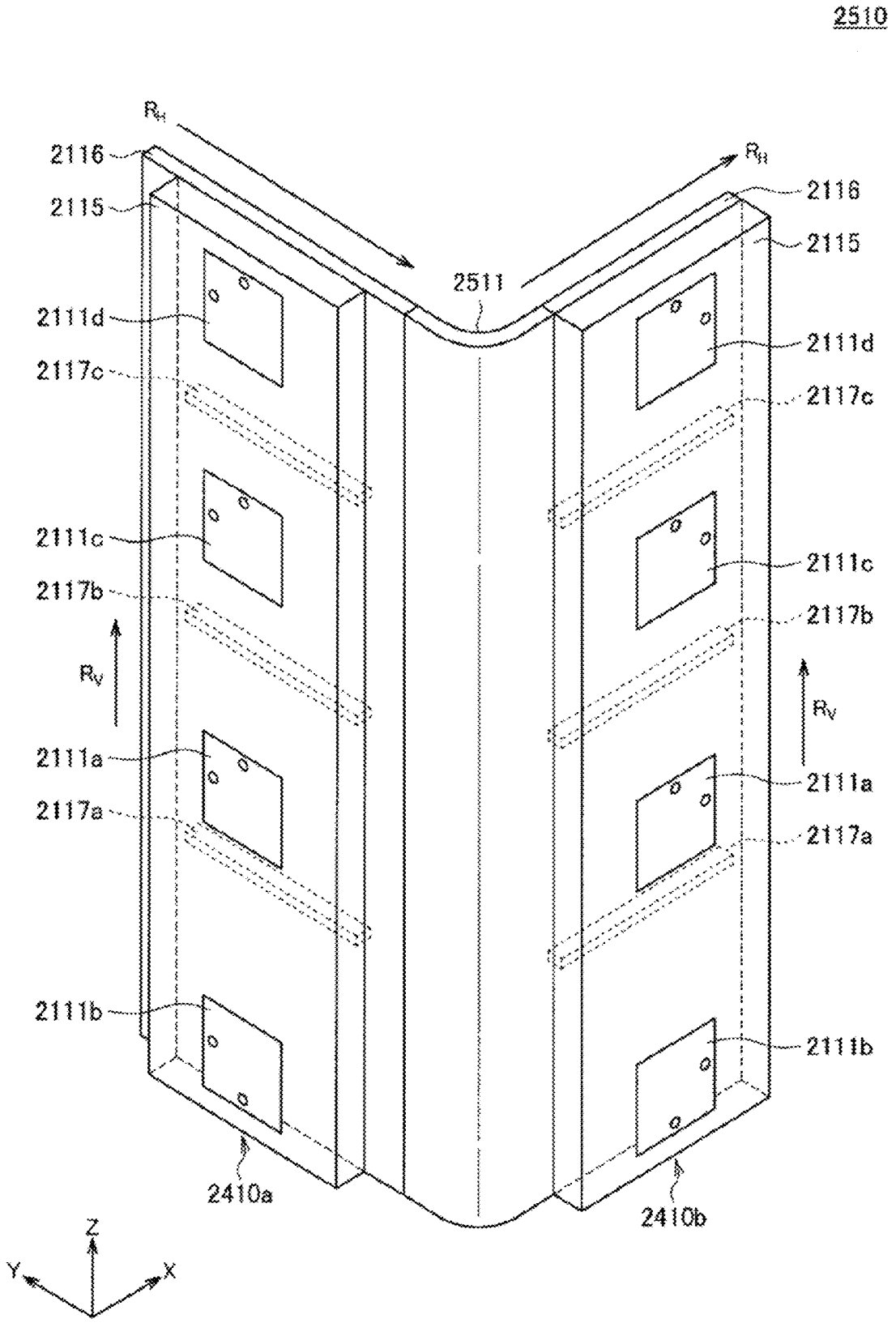
FIG. 17 is an explanatory view for describing an example of a configuration of an antenna device according to Example 2.

Next, as Example 2, an example of a case of configuring one antenna device by coupling two antenna devices in an L shape will be described. For example, FIG. 17 is an explanatory view for describing an example of a configuration of an antenna device according to Example 2. Note that, in the following description, the antenna device according to Example 2 may be referred to as an "antenna device 2510" in order to be distinguished from the antenna devices according to the above-described embodiment and other modifications and examples.

First, an example of a schematic configuration of the antenna device 2510 according to Example 2 will be described with reference to FIG. 17. FIG. 17 is a schematic perspective view of the antenna device 2510 according to Example 2. As illustrated in FIG. 17, the antenna device 2510 includes antenna units 2410*a* and 2410*b* and a coupling unit 2511. Each of the antenna units 2410*a* and 2410*b* corresponds to the antenna device 2410 described with reference to FIG. 16. Therefore, detailed description of the configuration of each of the antenna units 2410*a* and 2410*b* is omitted. Note that one of the antenna units 2410*a* and 2410*b* corresponds to an example of a "first antenna unit", and the other of the antenna units 2410*a* and 2410*b* corresponds to an example of a "second antenna unit".

Furthermore, in the present description, as illustrated in FIG. 17, the array direction of the plurality of antenna elements 2111 (that is, the antenna elements 2111*a* to 2111*d*) is defined as the z direction in each of the antenna units 2410*a* and 2410*b*. Furthermore, in the antenna unit 2410*a*, the direction horizontal to the plane of the element on the plane configuring each antenna element 2111 and orthogonal to the array direction (z direction) is defined as the y direction. That is, in the antenna unit 2410*a*, each slot 2117 (that is, each of slots 21117*a* to 2117*c*) is provided to extend in the y direction. Furthermore, in the antenna unit 2410*b*, the direction horizontal to the plane of the element on the plane configuring each antenna element 2111 and orthogonal to the array direction (z direction) is defined as the x direction. That is, in the antenna unit 2410*b*, each slot 2117 is provided to extend in the x direction.

As illustrated in FIG. 17, the antenna unit 2410*a* and the antenna unit 2410*b* are arranged such that one end portions of respective end portions, the one end portions extending in the array direction of the plurality of antenna elements 2111, are located close to each other. At this time, the antenna elements 2111 of the antenna unit 2410*a* and the antenna elements 2111 of the antenna unit 2410*b* are arranged such that the normal directions of the planar elements intersect with (for example, orthogonal to) each other, or the normal directions are twisted relative to each other. Furthermore, the coupling unit 2511 is provided between the antenna unit 2410*a* and the antenna unit 2410*b* to bridge the end portions located close to each other, so that the antenna unit 2410*a* and the antenna unit 2410*b* are coupled by the coupling unit 2511. That is, the antenna unit 2410*a* and the antenna unit 2410*b* are held by the coupling unit 2511 such that the antenna unit 2410*a* and the antenna unit 2410*b* form a substantially L shape.

The antenna device 2510 having the above configuration is favorably held along a plurality of surfaces (outer surfaces) connected to each other, of the outer surfaces of the housing 209, such as the back surface 201 and the end surface 204 illustrated in FIG. 4, for example. With such a configuration, for each of the plurality of surfaces connected to each other, each of a plurality of polarized waves coming from a direction substantially perpendicular to the surface and having different polarization directions from each other can be transmitted or received in a more favorable manner.

As Example 2, an example of the case of configuring one antenna device by coupling two antenna devices in an L shape has been described with reference to FIG. 17. Note that the configuration of the antenna device described as Example 2 is merely an example, and does not necessarily limit the configuration of the antenna device according to the present embodiment. As a specific example, the number of antenna elements 2111 provided in each of the antenna units 2410*a* and 2410*b* is not particularly limited as long as the number is two or larger. Furthermore, the numbers of antenna elements 2111 respectively provided in the antenna units 2410*a* and 2410*b* may be different. Furthermore, dimensions of each unit are not limited as long as the conditions of the slot length L, the element interval d, and the distance p between the antenna element 2111 and the slot 2117 (that is, the slot position) are satisfied, as described with reference to FIG. 13.

Example 3: Simulation Result

Next, as Example 3, an example of a simulation result of the radiation pattern according to the conditions of the slot length, the element interval, and the slot position will be described with a specific example.

Figure 18:
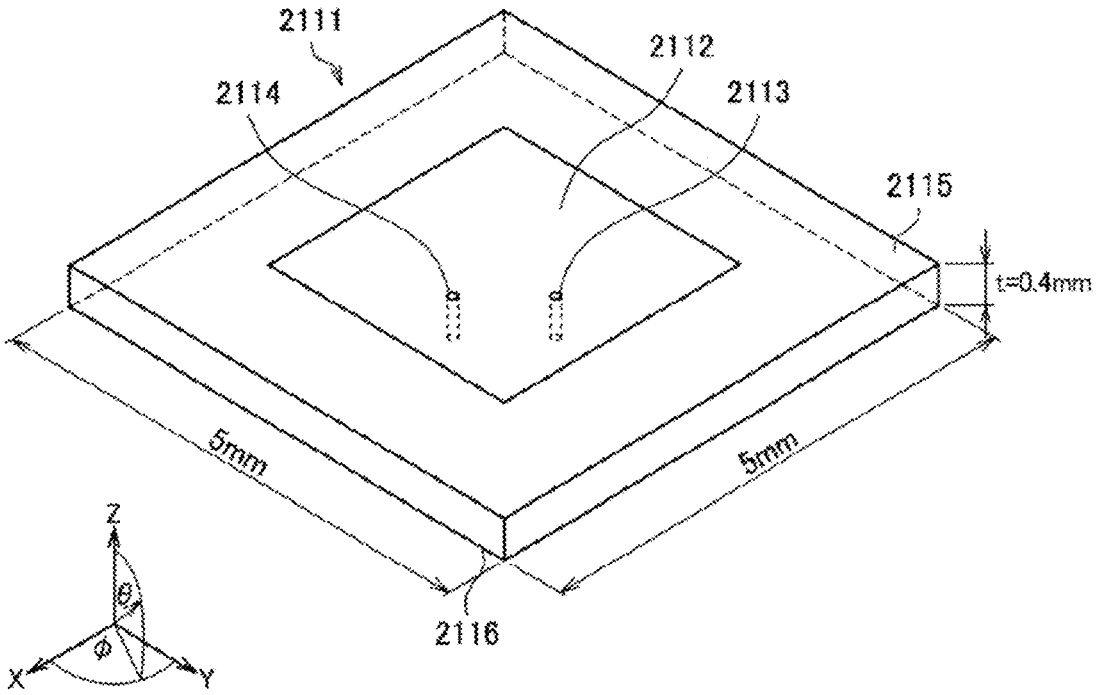
FIG. 18 is an explanatory view for describing an example of a configuration of an antenna element according to Comparative Example 1.
Figure 19:
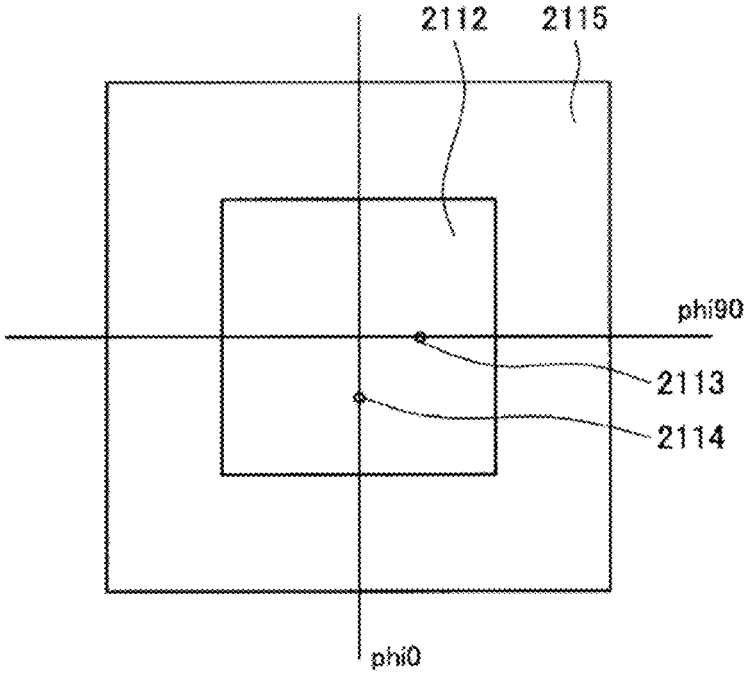
FIG. 19 is an explanatory view for describing an example of the configuration of the antenna element according to Comparative Example 1.

First, as Comparative Example 1, a configuration of a single antenna element 2111 to be simulated will be described with reference to FIGS. 18 and 19. FIGS. 18 and 19 are explanatory views for describing an example of a configuration of the antenna element according to Comparative Example 1. Specifically, FIG. 18 is a schematic perspective view of an antenna element according to Comparative Example 1. Furthermore, FIG. 19 illustrates an example of a schematic configuration of the antenna element in a case of viewing the antenna element according to Comparative Example 2 from the normal direction of the planar element.

As illustrated in FIG. 18, the antenna element 2111 according to Comparative Example 1 is formed to have the width in the planar direction of 5 mm and the thickness of 0.4 mm. Furthermore, as illustrated in FIG. 19, in the present description, for convenience, a plane including the feeding point 2114, and extending in the polarization direction of the signal corresponding to the feeding point 2114 (the vertical direction in FIG. 19) and the normal direction of the antenna element 2112 (the depth direction in FIG. 19) is referred to as a "phi0 plane". Furthermore, a plane including the feeding point 2113, and extending in the polarization direction of the signal corresponding to the feeding point 2113 (the cross direction in FIG. 19) and the normal direction of the antenna element 2112 (the depth direction in FIG. 19) is referred to as a "phi90 plane".

Furthermore, the frequency of the wireless signal transmitted with the power feed to the feeding points 2113 and 2114 is 28 GHz. Furthermore, two polarized waves corresponding to the feeding points 2113 and 2114 are two linear orthogonal polarized waves. Furthermore, the relative dielectric constant of the dielectric forming the dielectric substrate 2115 is 3.3.

Figure 20:
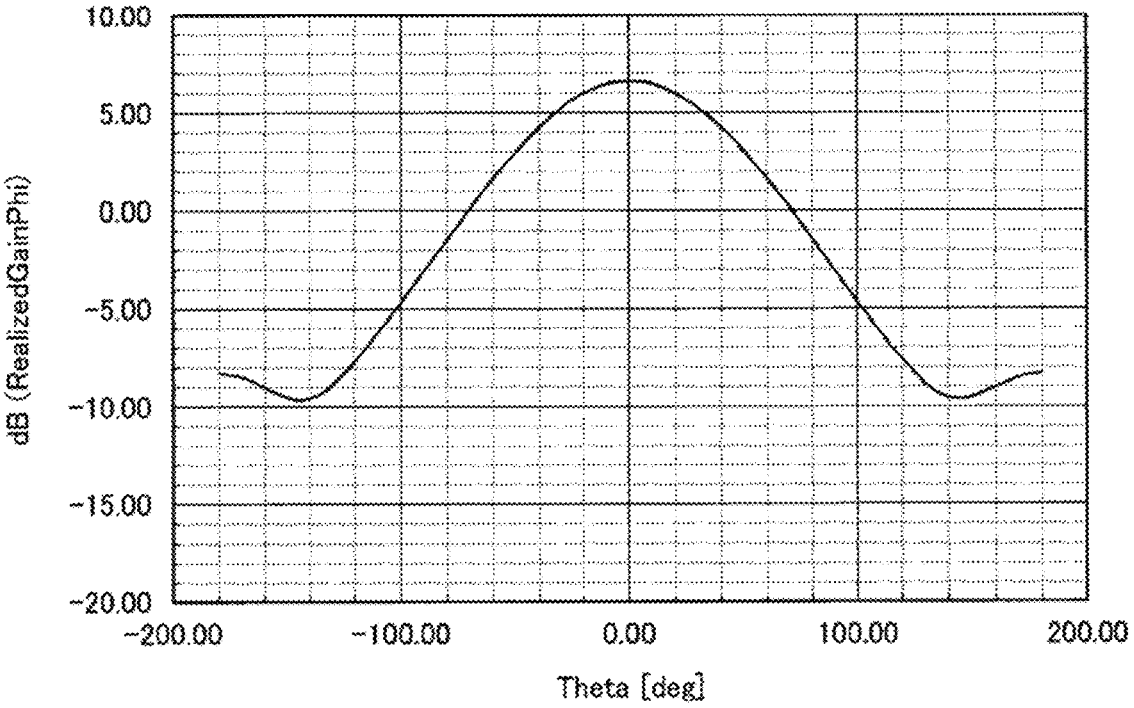
FIG. 20 is a graph illustrating an example of a simulation result of a radiation pattern of the antenna element according to Comparative Example 1.
Figure 21:
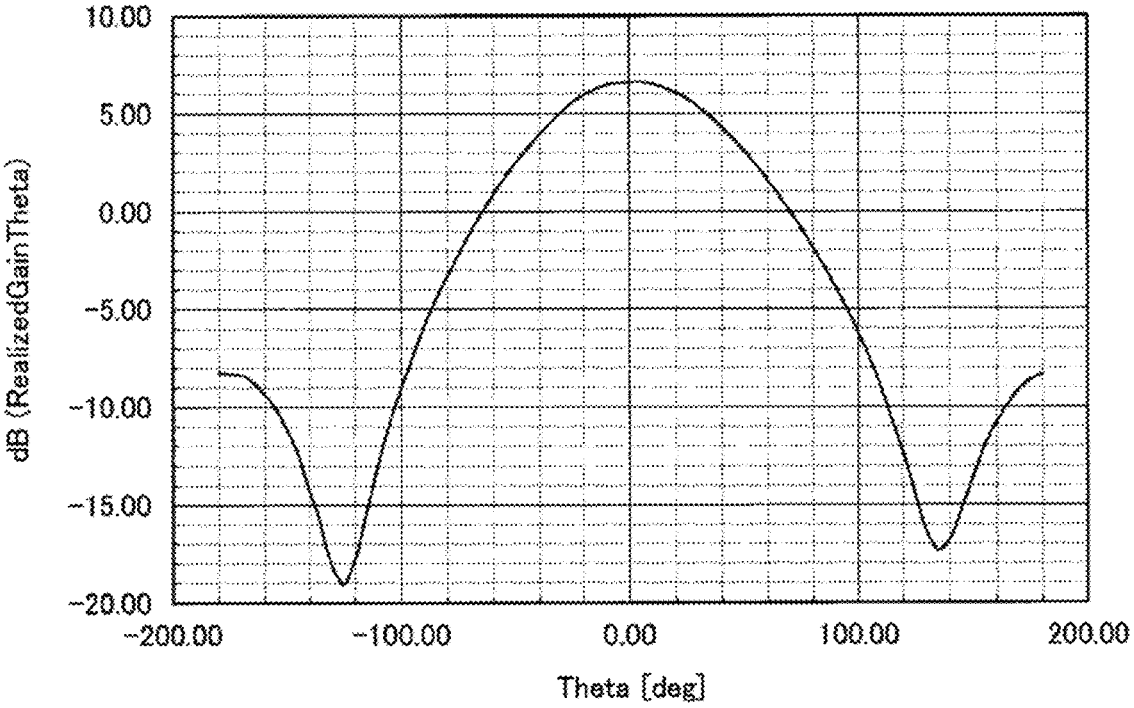
FIG. 21 is a graph illustrating an example of a simulation result of the radiation pattern of the antenna element according to Comparative Example 1.

Next, an example of a simulation result of the radiation pattern of the antenna element 2111 according to Comparative Example 1 above will be described with reference to FIGS. 20 and 21. FIGS. 20 and 21 are diagrams each illustrating an example of a simulation result of the radiation pattern of the antenna element 2111 according to Comparative Example 1. Specifically, FIG. 20 illustrates an example of the radiation pattern in a case where the radiation pattern caused with the power feed to the feeding point 2113 is cut by the phi90 plane. In FIG. 20, the horizontal axis represents an angle (deg) in a theta direction illustrated in FIG. 18, and the vertical axis represents the gain (dB) of the wireless signal. Furthermore, FIG. 21 illustrates an example of the radiation pattern in a case where the radiation pattern caused with the power feed to the feeding point 2114 is cut by the phi90 plane. The vertical axis and horizontal axis in FIG. 21 are similar to those in FIG. 20.

As illustrated in FIGS. 20 and 21, it can be seen that the antenna element 2111 according to Comparative Example 1 has no distortion in the radiation pattern.

Next, as Comparative Example 2, an example of a simulation result of the radiation pattern in an antenna device in which three antenna elements 2111 according to Comparative Example 1 are arrayed will be described. For example, FIG. 22 is an explanatory view for describing an example of a schematic configuration of the antenna device according to Comparative Example 2, illustrating an example of a schematic configuration of the antenna element in a case of viewing the antenna device from the normal direction of the planar element.

Figure 22:
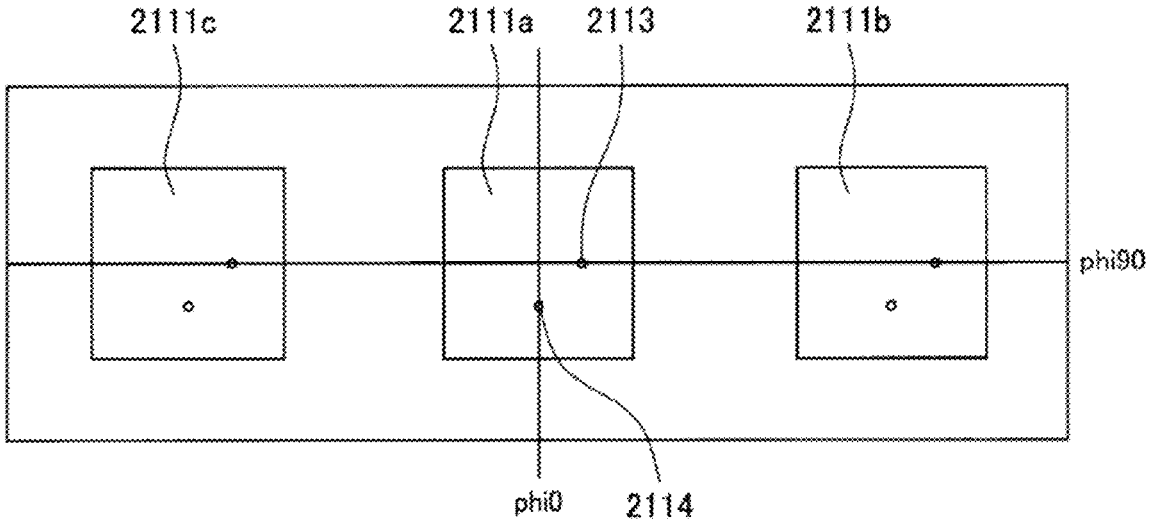
FIG. 22 is an explanatory view for describing an example of a schematic configuration of an antenna device according to Comparative Example 2.

In the example illustrated in FIG. 22, the antenna device is configured by arraying the three antenna elements 2111 in the array direction that is the polarization direction (the cross direction in FIG. 22) of the signal corresponding to the feeding point 2113. That is, the array direction is parallel to the phi90 plane and is perpendicular to the phi0 plane in the antenna device according to Comparative Example 2.

Note that, in the present description, the antenna element 2111 disposed in the center is referred to as the "antenna element 2111*a*" and the other two antenna elements 2111 are referred to as the "antenna element 2111*b*" and "antenna element 2111*c*", similarly to the example described with reference to FIG. 7. That is, the antenna element 2111*a* corresponds to the first antenna element, and the antenna elements 2111*b* and 2111*c* correspond to the second antenna elements.

Furthermore, as described above, the distortion caused by arraying the plurality of antenna elements tends to mainly occur in the array direction of the plurality of antenna elements. Therefore, in the following description, an example of a simulation result of the radiation pattern of the antenna element 2111*a* corresponding to the first antenna element will be described, focusing on only the phi90 plane parallel to the array direction.

Figure 23:
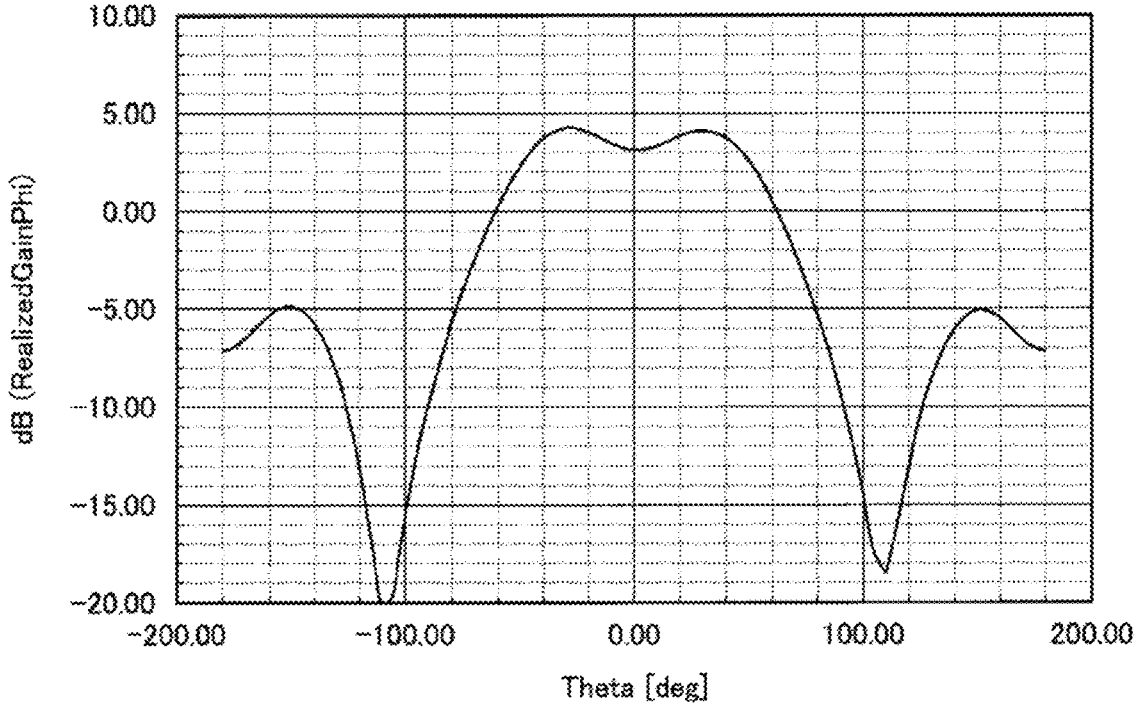
FIG. 23 is a graph illustrating an example of a simulation result of a radiation pattern of the antenna device according to Comparative Example 2.
Figure 24:
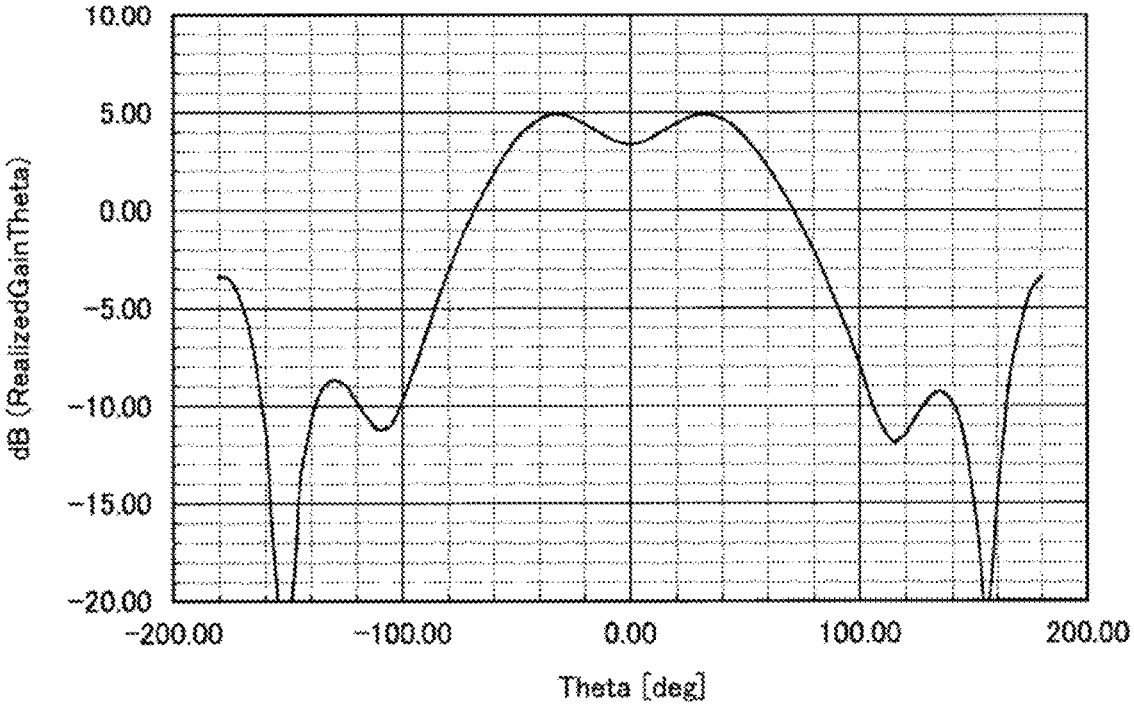
FIG. 24 is a graph illustrating an example of a simulation result of the radiation pattern of the antenna device according to Comparative Example 2.

For example, FIGS. 23 and 24 are graphs each illustrating an example of a simulation result of the radiation pattern of the antenna device according to Comparative Example 2. Specifically, specifically, FIG. 23 illustrates an example of the radiation pattern in a case where the radiation pattern of the antenna element 2111*a* caused with the power feed to the feeding point 2114 is cut by the phi90 plane. Furthermore, FIG. 24 illustrates an example of the radiation pattern in a case where the radiation pattern of the antenna element 2111*a* caused with the power feed to the feeding point 2113 is cut by the phi90 plane. Note that the vertical axis and the horizontal axis in FIGS. 23 and 24 are similar to those in FIG. 20.

As can be seen from a comparison of FIGS. 23 and 24 with FIGS. 20 and 21, the distortion has occurred in the radiation pattern in the antenna device according to Comparative Example 2, as compared with the antenna element according to Comparative Example 1.

Example 1-1: Study on Slot Length

Next, examples of a simulation result of the radiation pattern of the antenna element 2111*a* in a case of providing the above-described slot 2117 in the antenna device illustrated in FIG. 22 and changing the conditions of the slot length L of the slot 2117 will be described. Note that the slot 2117 is provided between the antenna element 2111*a* and each of the antenna elements 2111*b* and 2111*c*, similarly to the example described with reference to FIG. 9. Furthermore, the slot position is the center between antenna elements 2111 next to each other. Furthermore, the element interval d is d=5 mm. Furthermore, as the antenna element 2111*a*, an antenna element similar to the antenna element 2111 according to the first comparative example is applied.

Here, considering the conditions of the slot length L described as (Expression 1) and (Expression 2), the slot length L desirably satisfies the condition of $L>\lambda_g/2=3.65$ mm. Therefore, simulation of the radiation pattern of the antenna element 2111*a* has been performed in the case of L=4.2 mm (L>3.65 mm), in the case of L=3.65 mm, and in the case of L=3.6 mm (L<3.65 mm).

Figure 25:
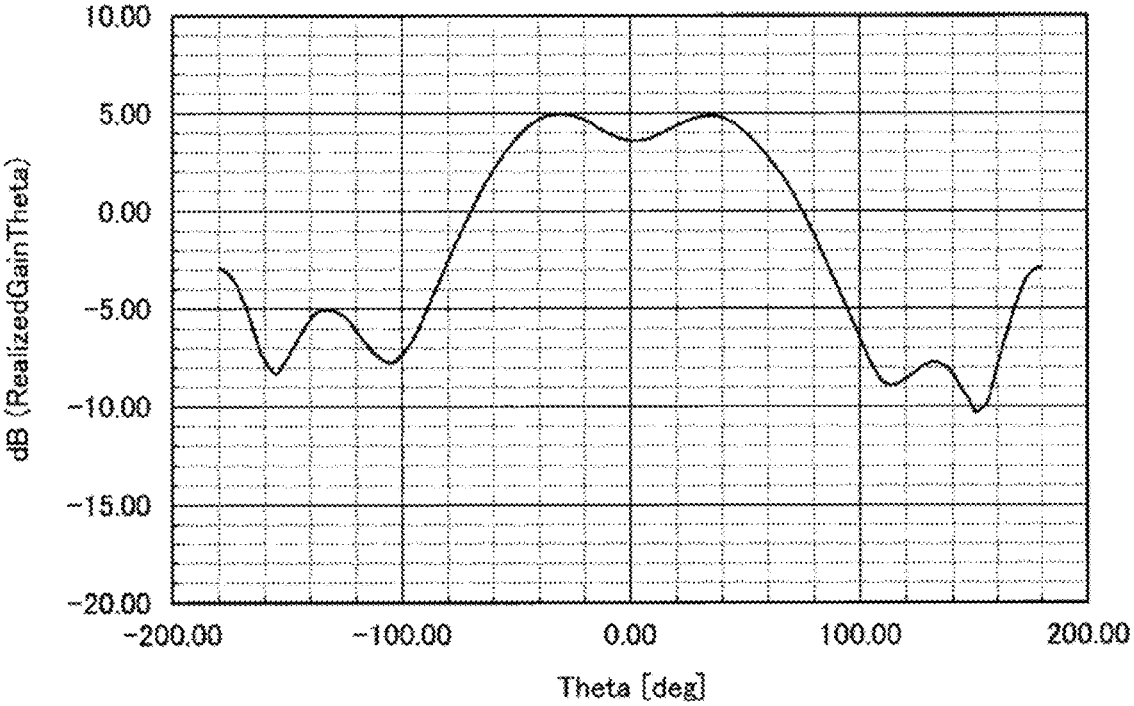
FIG. 25 is a graph illustrating an example of a simulation result of a radiation pattern according to a condition of a slot length in an antenna device according to Example 1.
Figure 26:
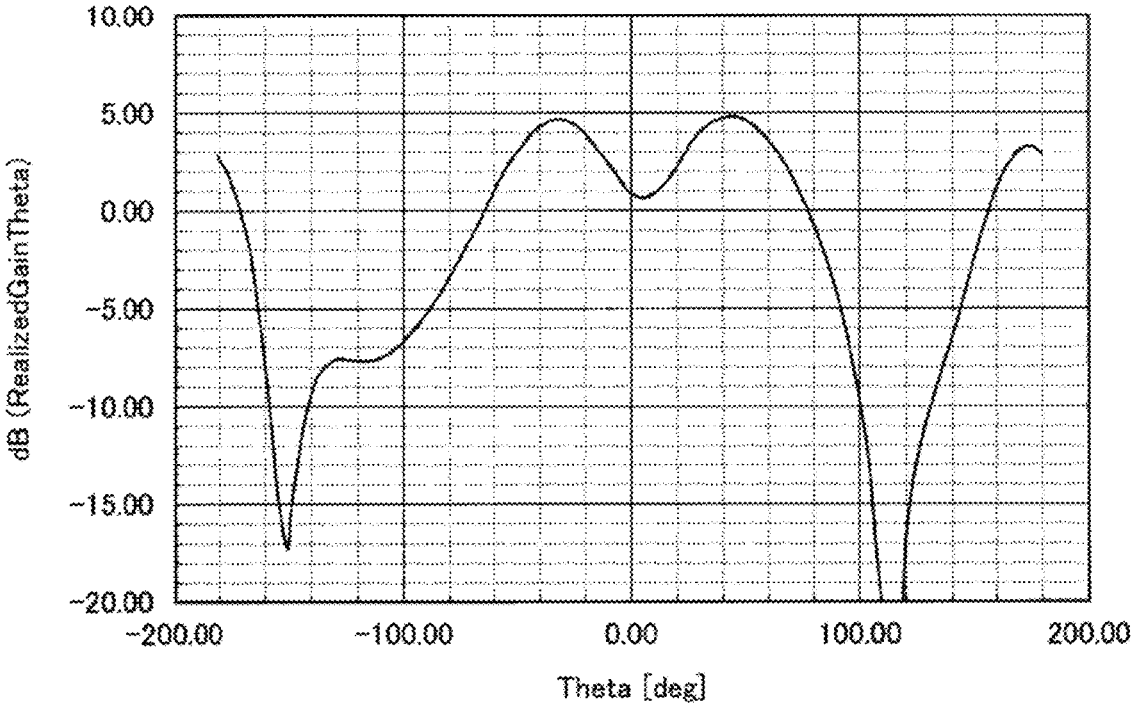
FIG. 26 is a graph illustrating an example of a simulation result of the radiation pattern according to a condition of the slot length in the antenna device according to Example 1.
Figure 27:
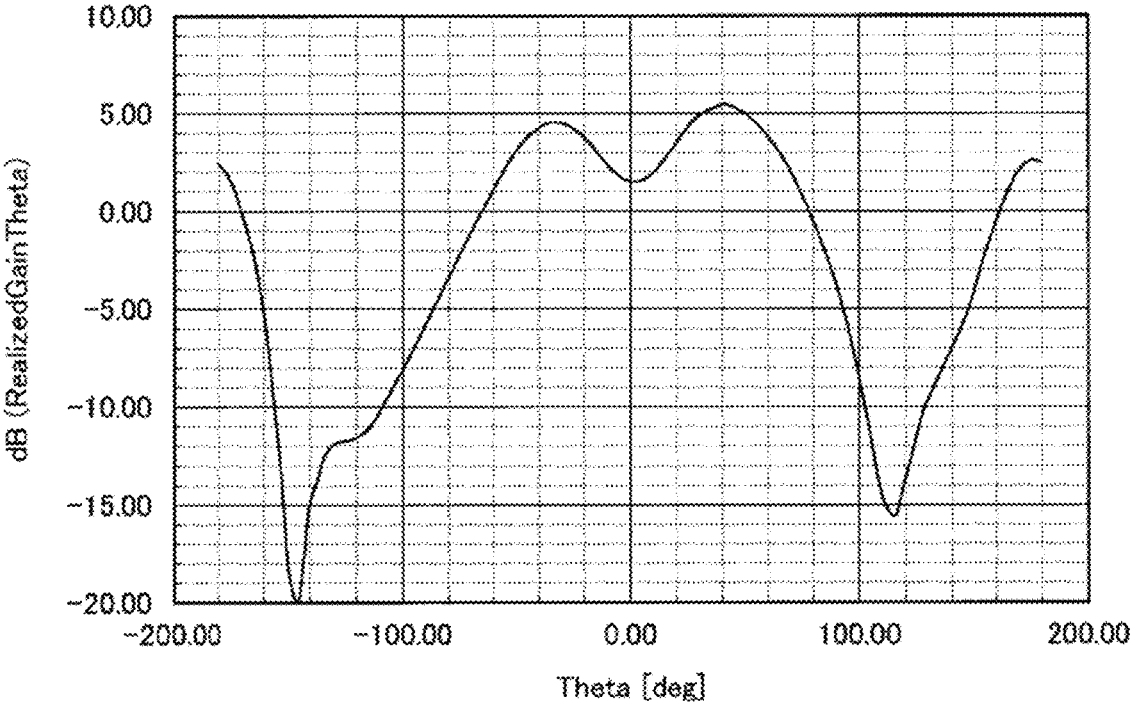
FIG. 27 is a graph illustrating an example of a simulation result of the radiation pattern according to a condition of the slot length in the antenna device according to Example 1.

FIGS. 25 to 27 are diagrams each illustrating an example of a simulation result of a radiation pattern according to a condition of a slot length in an antenna device according to Example 1. Specifically, FIGS. 25 to 27 illustrate examples of the radiation pattern in a case where the radiation pattern of the antenna element 2111*a* caused with the power feed to the feeding point 2113 is cut by the phi90 plane. More specifically, FIG. 25 illustrates an example of a simulation result of the radiation pattern of the antenna element 2111*a* in the case of the slot length L=4.2 mm. Furthermore, FIG. 26 illustrates an example of a simulation result of the radiation pattern of the antenna element 2111*a* in the case of the slot length L=3.65 mm. Furthermore, FIG. 27 illustrates an example of a simulation result of the radiation pattern of the antenna element 2111*a* in the case of the slot length L=3.6 mm. Note that the vertical axis and the horizontal axis in FIGS. 25 to 27 are similar to those in FIG. 20.

As can be seen from a comparison of FIG. 25 with FIG. 24, the characteristic of a portion corresponding to a minimum value of the radiation pattern of the antenna is improved by providing the slot 2117, as compared with the case without the slot 2117.

Furthermore, as can be seen from a comparison of FIG. 25 with each of FIGS. 26 and 27, the simulation result of the case where the conditions of (Expression 1) and (Expression 2) are satisfied illustrated in FIG. 25 has been improved in distortion, as compared with the simulation results of the cases where the conditions are not satisfied illustrated in FIGS. 26 and 27. In particular, as for the example in the case of $L=\lambda_g/2=3.65$ mm illustrated in FIG. 26, it can be seen that the coupling between the antenna element 2111*a* and the slot 2117 becomes stronger and the distortion becomes even larger.

Examples of the simulation result of the radiation pattern of the antenna element 2111*a* in the case of providing the above-described slot 2117 in the antenna device illustrated in FIG. 22 and changing the conditions of the slot length L of the slot 2117 have been described.

Example 1-2: Study on Element Interval

Next, examples of a simulation result of the radiation pattern of the antenna element 2111*a* in a case of changing the condition of the element interval d between two antenna elements 2111 next to each other in the antenna device illustrated in FIG. 22 will be described. Note that, in the present description, the slot 2117 is not provided, and only the condition of the element interval d is changed. Furthermore, as the antenna element 2111*a*, an antenna element similar to the antenna element 2111 according to the first comparative example is applied.

Here, considering the condition of the element interval d described as (Expression 3), the wavelength $\lambda_0=10.7$ mm of the wireless signal is satisfied. Therefore, the element interval d desirably satisfies the condition of 5.4 mmm≤d<10.7 mm Note that, as described above, an upper limit side of the element interval d is determined according to the occurrence conditions of grating lobes. Therefore, in the present description, an example of simulation of a radiation pattern mainly focusing on a condition with a lower limit-side boundary value as a base point will be described. Specifically, simulation of the radiation pattern of the antenna element 2111*a* has been performed in the case of the element interval d=6.0 mm (5.4 mm<d<10.7 mm), in the case of d=5.4 mm, and in the case of d=4.0 mm (d<5.4 mm).

Figure 28:
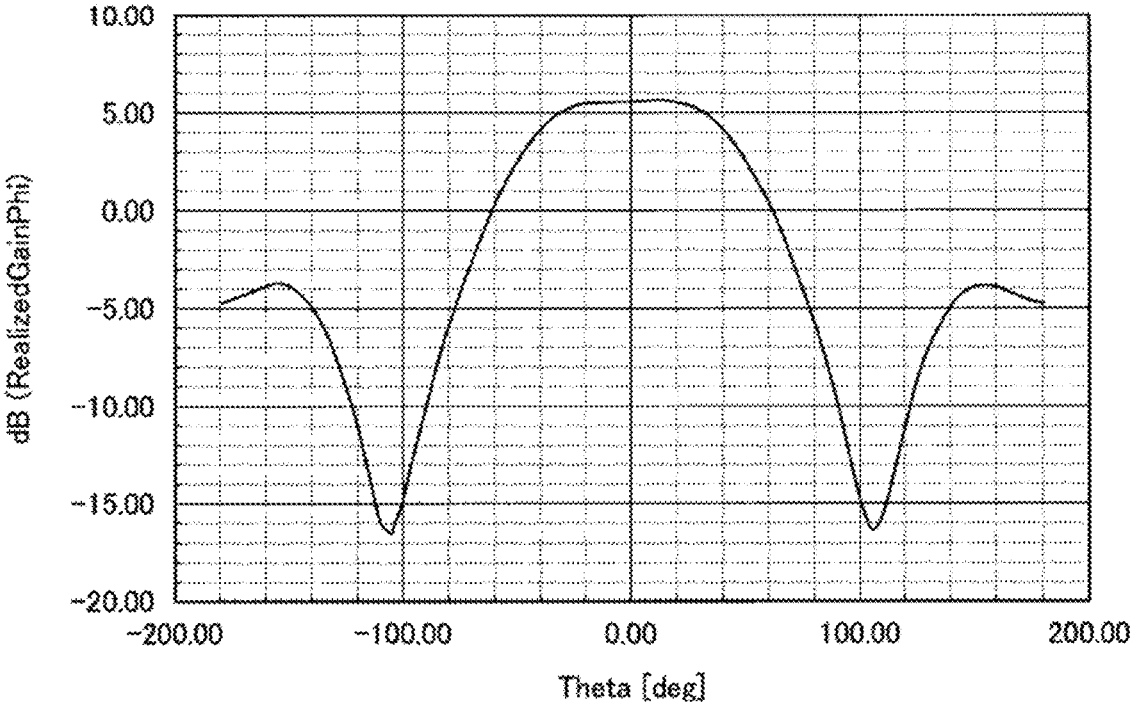
FIG. 28 is a graph illustrating an example of a simulation result of the radiation pattern according to a condition of an element interval in the antenna device according to Example 1.
Figure 29:
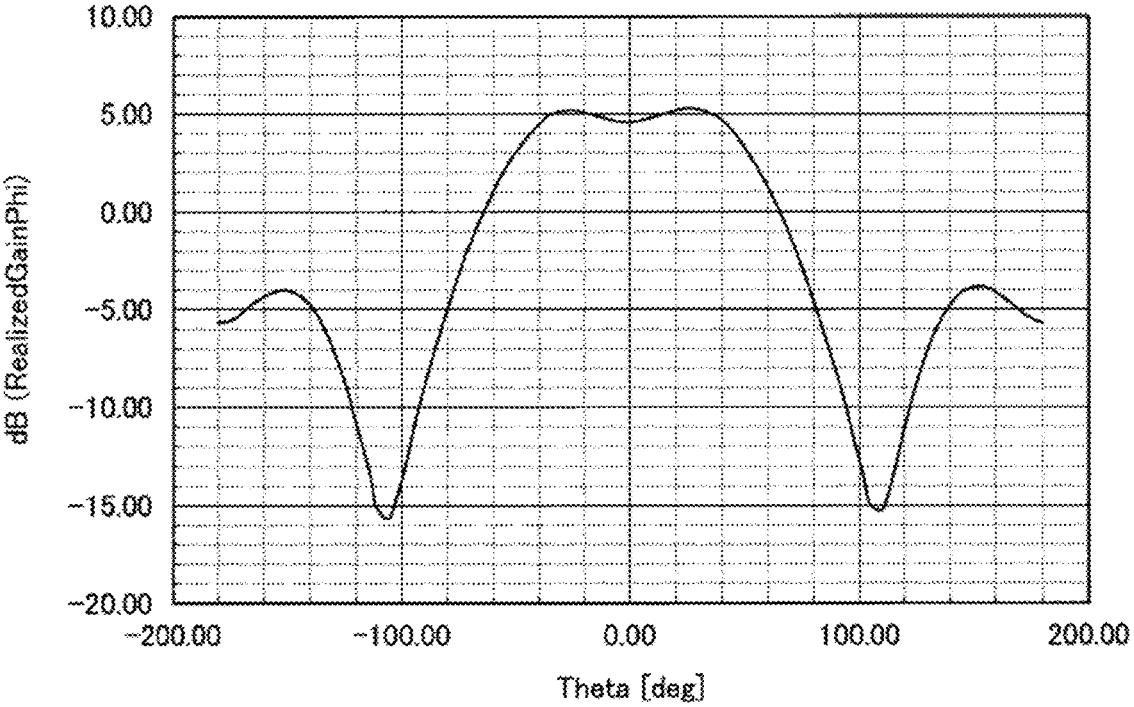
FIG. 29 is a graph illustrating an example of a simulation result of the radiation pattern according to a condition of the element interval in the antenna device according to Example 1.
Figure 30:
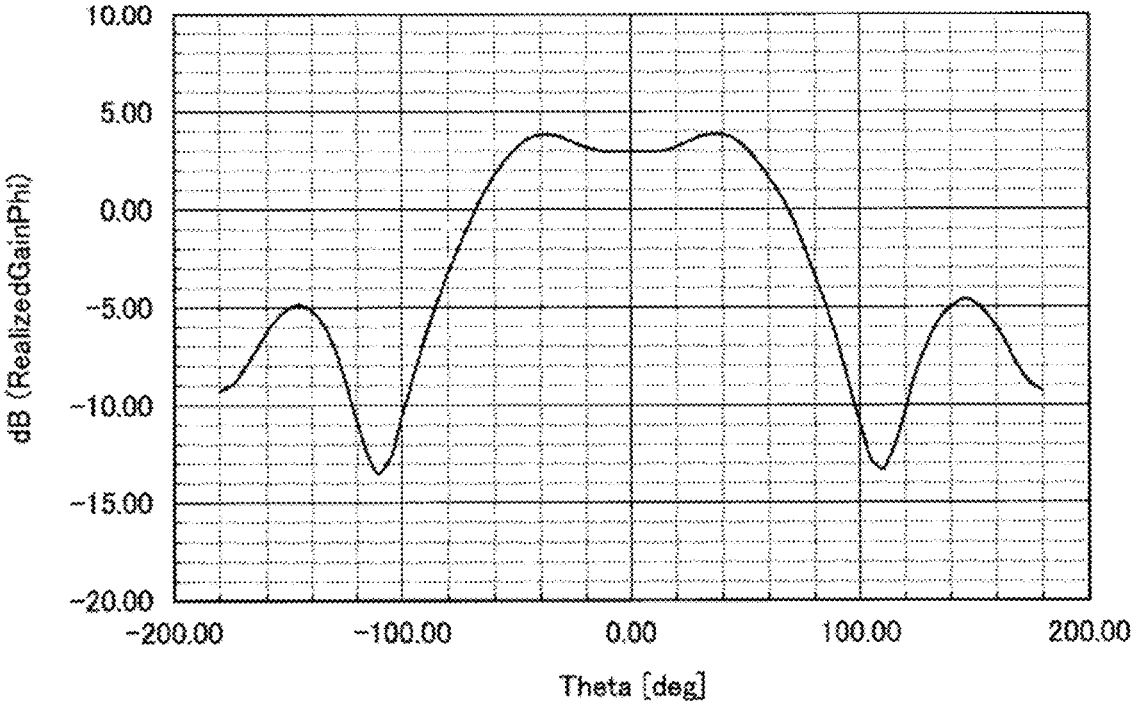
FIG. 30 is a graph illustrating an example of a simulation result of the radiation pattern according to a condition of the element interval in the antenna device according to Example 1.

FIGS. 28 to 30 are graphs each illustrating an example of a simulation result of the radiation pattern according to the condition of the element interval in the antenna device according to Example 1. Specifically, FIGS. 28 to 30 illustrate examples of the radiation pattern in a case where the radiation pattern of the antenna element 2111*a* caused with the power feed to the feeding point 2114 is cut by the phi90 plane. More specifically, FIG. 28 illustrates an example of a simulation result of the radiation pattern of the antenna element 2111*a* in the case of the element interval d=6.0 mm. Furthermore, FIG. 29 illustrates an example of a simulation result of the radiation pattern of the antenna element 2111*a* in the case of the element interval d=5.4 mm. Furthermore, FIG. 30 illustrates an example of a simulation result of the radiation pattern of the antenna element 2111*a* in the case of the element interval d=4.0 mm. Note that the vertical axis and the horizontal axis in FIGS. 28 to 30 are similar to those in FIG. 20.

As can be seen from a comparison of FIG. 28 with FIG. 23, the distortion caused in the radiation pattern has been improved by setting the element interval d to satisfy the condition of 5.4 mm d<10.7 mm.

Furthermore, as can be seen from a comparison of each of FIGS. 28 and 29 with FIG. 30, the simulation result of the case where the condition of (Expression 3) is satisfied illustrated in FIGS. 28 and 29 has been improved in distortion, as compared with the simulation result of the case where the condition is not satisfied illustrated in FIG. 30. In particular, it can be seen that the width of the distortion becomes wider in the example illustrated in FIG. 30 than the case illustrated in FIG. 24.

Examples of the simulation result of the radiation pattern of the antenna element 2111*a* in the case of changing the condition of the element interval d between two antenna elements 2111 next to each other in the antenna device illustrated in FIG. 22 have been described.

Example 1-3: Study on Slot Position

Next, examples of a simulation result of the radiation pattern of the antenna element 2111*a* in a case of providing the above-described slot 2117 in the antenna device illustrated in FIG. 22 and changing the condition of the slop position of the slot 2117 (that is, the distance p between the slot 2117 and the antenna element 2111*a*) will be described. Note that the slot 2117 is provided between the antenna element 2111*a* and each of the antenna elements 2111*b* and 2111*c*, similarly to the example described with reference to FIG. 9. Furthermore, the slot length L is set to L=4.0 mm. Furthermore, the element interval d is set to d=5 mm. Furthermore, as the antenna element 2111*a*, an antenna element similar to the antenna element 2111 according to the first comparative example is applied.

Here, considering the condition of the distance p (that is, the slot position) described as (Expression 6), the condition expressed as (Expression 7) below is established. Therefore, it is more favorable that the distance p satisfies the condition of 1.47 mm<p<3.53 mm.

[Math 6]

$$\frac{\lambda_0}{4\sqrt{\varepsilon_{r1}}} = 1.47 \text{ mm} \quad \text{(Expression 7)}$$

Note that the upper limit value side of the distance p corresponds to a position immediately before the slot 2117 reaches an edge of the second antenna element 2111*b* or 2111*c*. The influence on the second antenna element 2111*b* or 2111*c* in the case where the distance p exhibits the upper limit value is similar to the influence on the first antenna element 2111*a* in the case where the distance p exhibits the lower limit value. Therefore, in the present description, an example of simulation of a radiation pattern mainly focusing on a condition with a lower limit-side boundary value as a base point will be described. Specifically, simulation of the radiation pattern of the antenna element 2111*a* has been performed in the case of the distance p=2.8 mm (1.47 mm<p<3.53 mm), in the case of p=1.47 mm, and in the case of p=1.4 mm (p<1.47 mm).

Figure 31:
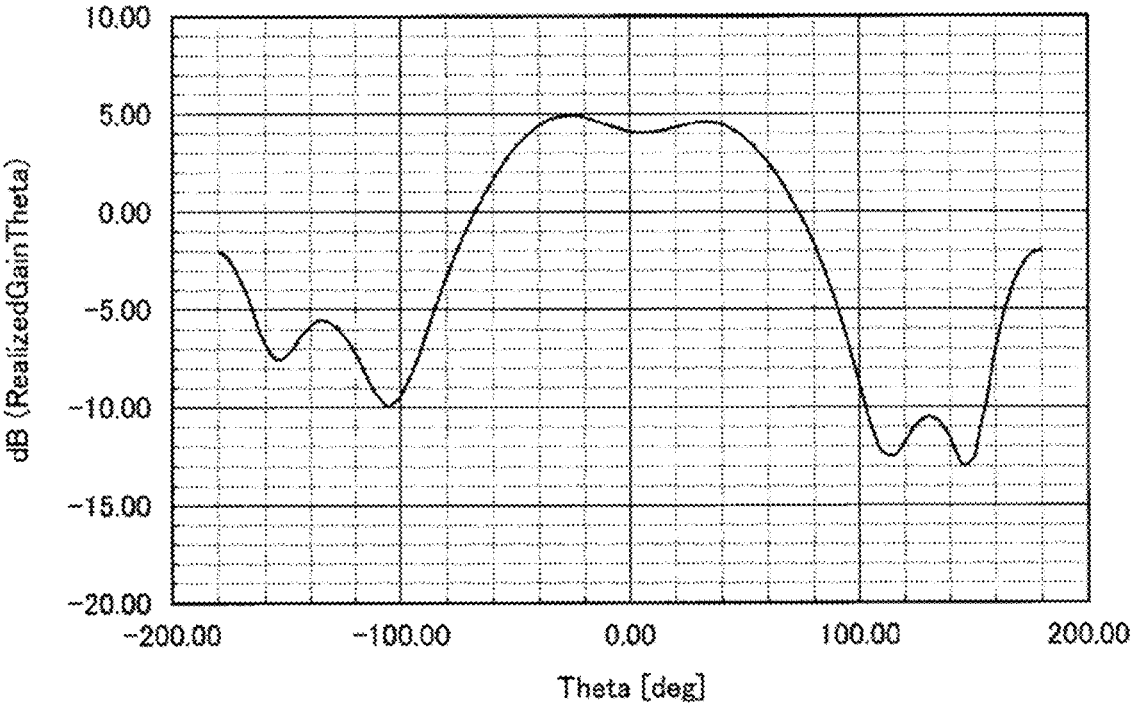
FIG. 31 is a graph illustrating an example of a simulation result of the radiation pattern according to a condition of the element interval in the antenna device according to Example 1.
Figure 32:
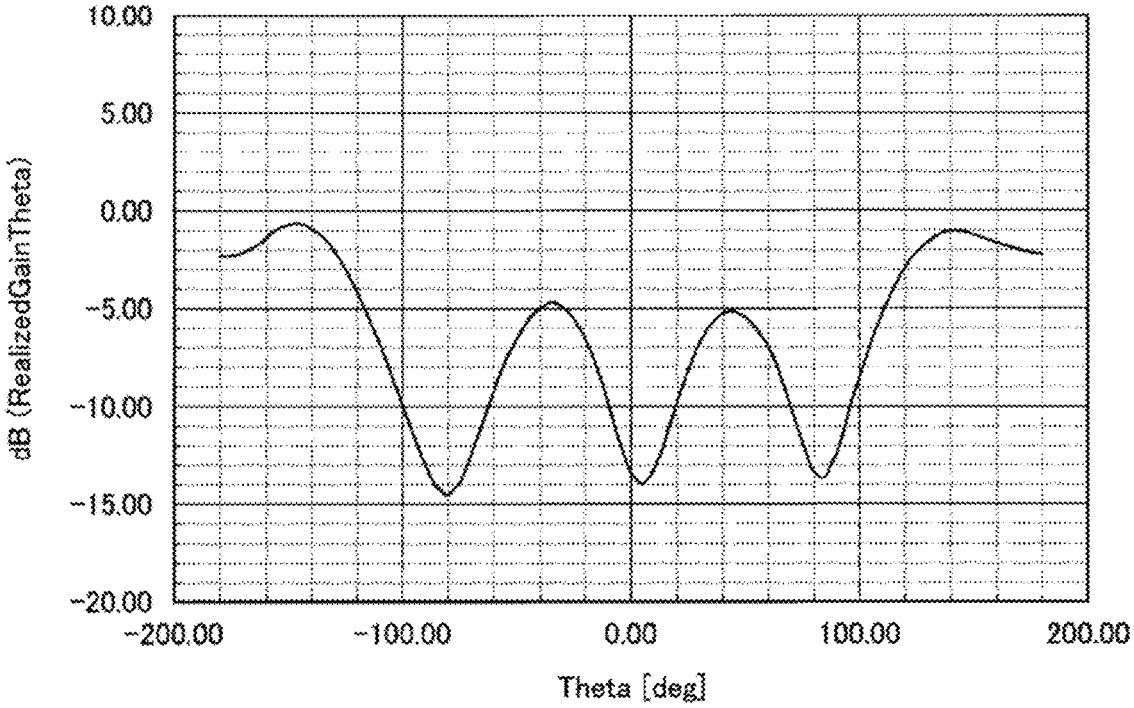
FIG. 32 is a graph illustrating an example of a simulation result of the radiation pattern according to a condition of the element interval in the antenna device according to Example 1.
Figure 33:
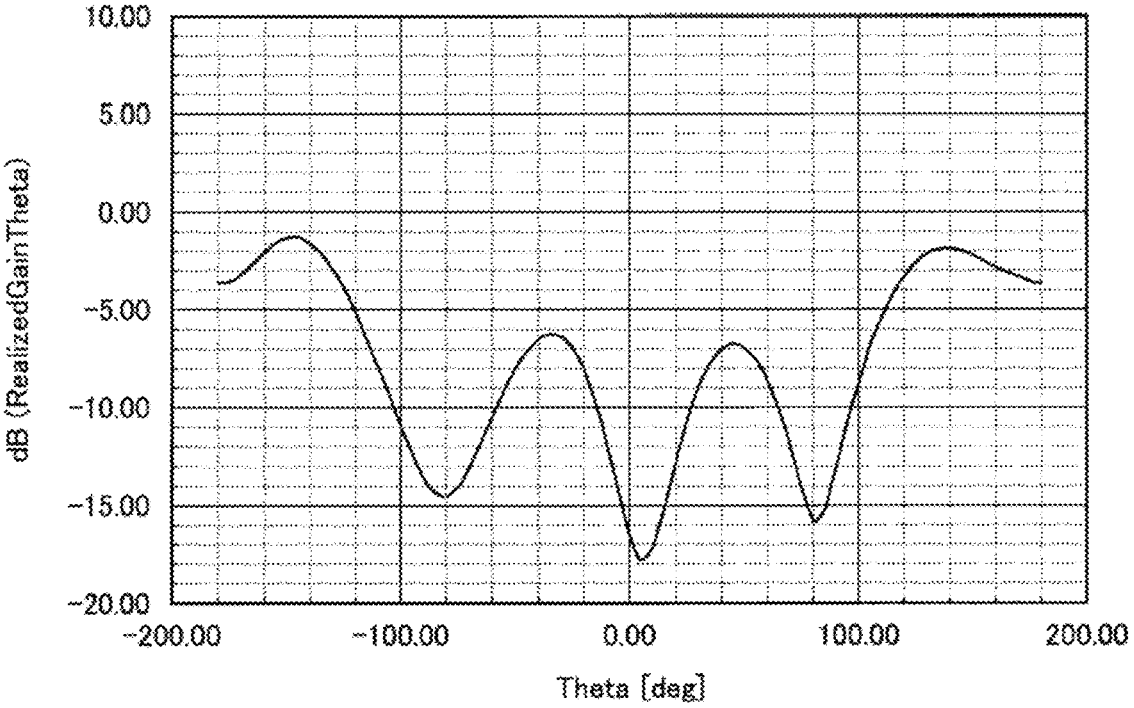
FIG. 33 is a graph illustrating an example of a simulation result of the radiation pattern according to a condition of the element interval in the antenna device according to Example 1.

FIGS. 31 to 33 are graphs each illustrating an example of a simulation result of the radiation pattern according to the condition of the slot position in the antenna device according to Example 1. Specifically, FIGS. 31 to 33 illustrate examples of the radiation pattern in a case where the radiation pattern of the antenna element 2111*a* caused with the power feed to the feeding point 2113 is cut by the phi90 plane. More specifically, FIG. 31 illustrates an example of a simulation result of the radiation pattern of the antenna element 2111*a* in the case of the distance p=2.8 mm. Furthermore, FIG. 32 illustrates an example of a simulation result of the radiation pattern of the antenna element 2111*a* in the case of the distance p=1.47 mm. Furthermore, FIG. 33 illustrates an example of a simulation result of the radiation pattern of the antenna element 2111*a* in the case of the distance p=1.4 mm. Note that the vertical axis and the horizontal axis in FIGS. 31 to 33 are similar to those in FIG. 20.

As can be seen from a comparison of FIG. 31 with FIG. 24, the distortion caused in the radiation pattern has been improved by setting the distance p to satisfy the condition of 1.47 mm<p<3.53 mm.

Furthermore, in FIGS. 32 and 33, the slot 2117 reaches an edge of the antenna element 2111*a* or the slot 2117 is provided below the planar element 2112 of the antenna element 2111*a*. Under such circumstances, the provision of the slot 2117 presumably disturbs an electric field caused between the element 2112 of the antenna element 2111*a* and the ground plate 2116, and affects the antenna characteristic. Therefore, for example, in the examples illustrated in FIGS. 32 and 33, the distortion has occurred in the radiation patterns of the antenna element 2111*a*.

Examples of the simulation result of the radiation pattern of the antenna element 2111*a* in the case of providing the above-described slot 2117 in the antenna device illustrated in FIG. 22 and changing the condition of the slot position of the slot 2117 have been described.

3.4. Application

Next, as an application of a communication device to which the antenna device according to the embodiment of the present disclosure is applied, an example of a case of applying the technology according to the present disclosure to a device other than a communication terminal such as a smartphone will be described.

In recent years, a technology called Internet of Things (IoT) that connects various things to a network has attracted attention, and devices other than smartphones and tablet terminals are assumed to be able to be used for communication. Therefore, for example, by applying the technology according to the present disclosure to various devices configured to be movable, the devices become able to communicate using millimeter waves and to use polarization MIMO in the communication.

Figure 34:
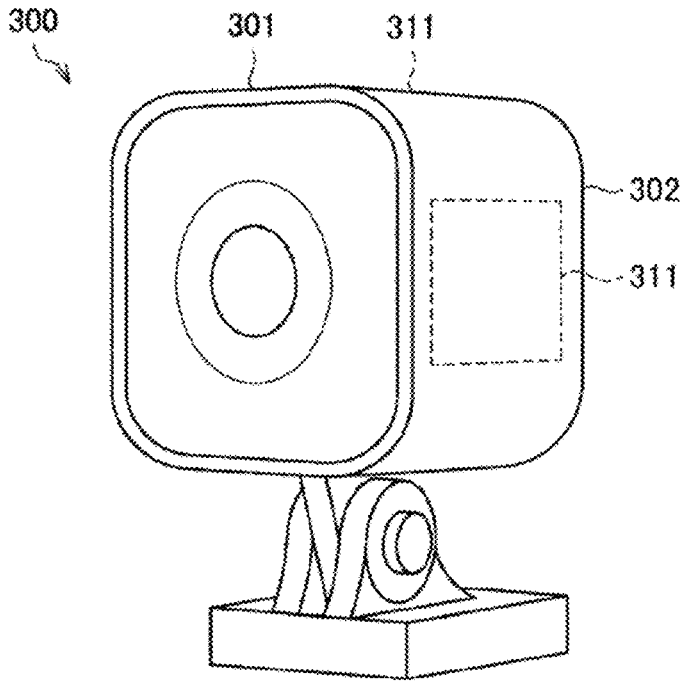
FIG. 34 is an explanatory view for describing an application of a communication device according to the embodiment.

For example, FIG. 34 is an explanatory view for describing an application of the communication device according to the present embodiment, illustrating an example of a case of applying the technology according to the present embodiment to a camera device. Specifically, in the example illustrated in FIG. 34, the antenna device according to the embodiment of the present disclosure is held to be located near each of surfaces 301 and 302 facing different directions from each other, of external surfaces of a housing of a camera device 300. For example, the reference numeral 311 schematically denotes the antenna device according to the embodiment of the present disclosure. With such a configuration, the camera device 300 illustrated in FIG. 34 can transmit or receive each of a plurality of polarized waves propagating in directions substantially coincident with the normal directions of the surfaces 301 and 302, and having different polarization directions from each other. Note that, needless to say, the antenna device 311 may be provided not only on the surfaces 301 and 302 illustrated in FIG. 34 but also on other surfaces.

Figure 35:
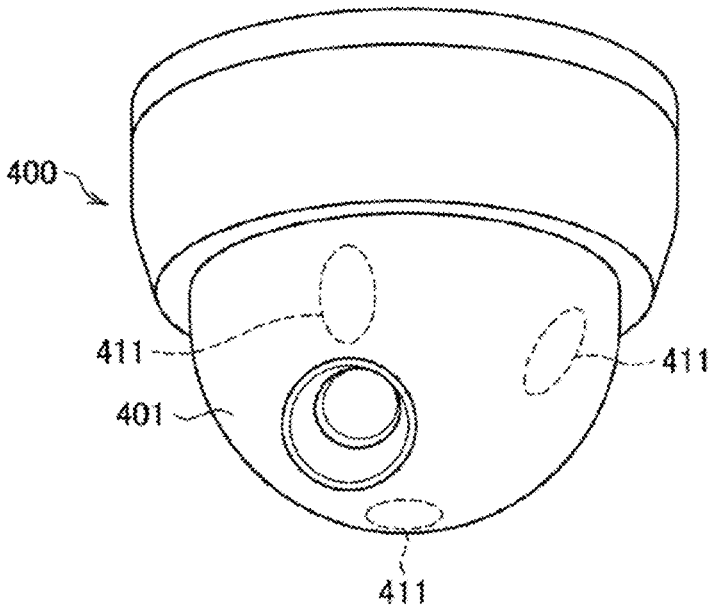
FIG. 35 is an explanatory view for describing an application of the communication device according to the embodiment.

Furthermore, the technology according to the present disclosure can also be applied to an unmanned aircraft called drone, for example. For example, FIG. 35 is an explanatory view for describing an application of the communication device according to the present embodiment, illustrating an example of a case of applying the technology according to the present embodiment to a camera device installed in a lower portion of a drone. Specifically, in the case of a drone flying in a high place, it is desirable for the drone to transmit or receive a wireless signal (millimeter wave) arriving from each direction mainly on a lower side. Therefore, for example, in the example illustrated in FIG. 35, the antenna device according to the embodiment of the present disclosure is held to be located near each of portions facing different directions from each other, of an outer surface 401 of a housing of a camera device 400 installed in a lower portion of the drone. For example, the reference numeral 411 schematically denotes the antenna device according to the embodiment of the present disclosure. Although not illustrated in FIG. 35, the antenna device 411 may be provided not only in the camera device 400 but also in each portion of the housing of the drone itself, for example. Even in this case, the antenna device 411 is favorably provided on, in particular, the lower side of the housing.

Note that, as illustrated in FIG. 35, in a case where at least a part of the external surface of the housing of the target device is curved (that is, is a curved surface), the antenna devices 411 are favorably held near a plurality of partial regions having normal directions intersecting with each other or twisted relative to each other, of partial regions in the curved surface. With such a configuration, the camera device 400 illustrated in FIG. 35 can transmit or receive each of a plurality of polarized waves propagating in the directions substantially coincident with the normal directions of the partial regions and having different polarization directions from each other.

Note that the examples described with reference to FIGS. 34 and 35 are mere examples, and the application destination of the technology according to the present disclosure is not particularly limited as long as the destination is a device capable of performing communication using millimeter waves.

As an application of the communication device to which the antenna device according to the embodiment of the present disclosure is applied, examples of the cases of applying the technology according to the present disclosure to devices other than a communication terminal such as a smartphone have been described with reference to FIGS. 34 and 35.

4. CONCLUSION

As described above, the antenna device according to the present embodiment includes the substantially planar dielectric substrate, the plurality of antenna elements, and the ground plate. The plurality of antenna elements is disposed on one surface of the dielectric substrate along the first direction horizontal to the plane of the dielectric substrate, and configured to respectively transmit or receive the first wireless signal and the second wireless signal having different polarization directions from each other. The ground plate is provided on substantially entire the other surface of the dielectric substrate, and provided with a long slot to extend in a second direction orthogonal to the first direction in a region corresponding to a region between a first antenna element and a second antenna element next to each other. Furthermore, the slot length L of the slot provided in the ground plate is formed to satisfy the conditions as described as (Expression 1) and (Expression 2).

Furthermore, the distance between respective centers of the first antenna element and the second antenna element (that is, the element interval d) may be formed to satisfy the condition as described as (Expression 3). Furthermore, the distance p between the center of the first antenna element and the center of the slot (that is, the slot position) may be formed to satisfy the conditions as described as (Expression 4) to (Expression 6).

With the above-described configuration, according to the antenna device of the present embodiment, a more favorable radiation pattern can be obtained as a radiation pattern of an antenna element even in a case of arraying a plurality of antenna elements.

Although the favorable embodiments of the present disclosure have been described in detail with reference to the accompanying drawings, the technical scope of the present disclosure is not limited to such examples. It is obvious that persons having ordinary knowledge in the technical field of the present disclosure can conceive various changes and alterations within the scope of the technical idea described in the claims, and it is naturally understood that these changes and alterations belong to the technical scope of the present disclosure.

Furthermore, the effects described in the present specification are merely illustrative or exemplary and are not restrictive. That is, the technology according to the present disclosure can exhibit other effects obvious to those skilled in the art from the description of the present specification together with or in place of the above-described effects.

Note that following configurations also belong to the technical scope of the present disclosure.

(1)

An antenna device including:

a substantially planar dielectric substrate;

a plurality of antenna elements disposed on one surface of the dielectric substrate along a first direction horizontal to a plane of the dielectric substrate, and configured to respectively transmit or receive a first wireless signal and a second wireless signal having different polarization directions from one another; and a ground plate provided on substantially entire the other surface of the dielectric substrate, and provided with a long slot to extend in a second direction orthogonal to the first direction in a region corresponding to a region between a first antenna element and a second antenna element next to each other, in which a length L in the second direction of the slop satisfies a conditional expression below.

[Math. 7]

$$L > \frac{\lambda_g}{2}, \lambda_g = \frac{\lambda_0}{\sqrt{(\varepsilon_{r1} + \varepsilon_{r2})/2}}$$

where a wavelength of the wireless signal transmitted or received by each of the plurality of antenna elements is $\lambda_0$, a relative dielectric constant of the dielectric substrate is $\varepsilon_{r1}$, and a relative dielectric constant of a dielectric located on an opposite side of the dielectric substrate with respect to the ground plate is $\varepsilon_{r2}$.

(2)

The antenna device according to (1), in which a distance d between respective centers of the first antenna element and the second antenna element satisfies a conditional expression below.

[Math. 8]

$$\frac{\lambda_0}{2} \leq d < \lambda_0$$

(3)

The antenna device according to (1) or (2), in which a distance p along the first direction between a center of the first antenna element and the slot satisfies a conditional expression below.

[Math. 9]

$$\frac{\lambda_0}{4\sqrt{\varepsilon_{r1}}} < p < d - \frac{\lambda_0}{4\sqrt{\varepsilon_{r1}}}$$

(4)

The antenna device according to any one of (1) to (3), in which the first wireless signal has the polarization direction substantially coincident with first direction, the second wireless signal has the polarization direction substantially coincident with the second direction, and a first feeding point corresponding to the first wireless signal and a second feeding point corresponding to the second wireless signal are provided for each of the antenna elements.

(5)

The antenna device according to (4), in which the first feeding point in the second antenna element is eccentrically provided in a direction of an end portion, of end portions in the first direction of the second antenna element, the end portion being on an opposite side of the first antenna element.

(6)

The antenna device according to any one of (1) to (5), in which the antenna element is configured as a planar antenna.

(7)

The antenna device according to any one of (1) to (6), further including:

a first antenna unit and a second antenna unit each including the dielectric substrate, the plurality of antenna elements, and the ground plate, in which the first antenna unit and the second antenna unit are held such that respective normal directions intersect with each other or the normal directions are twisted relative to each other, with respect to a predetermined housing.

(8)

The antenna device according to (7), further including: a coupling unit configured to couple an end portion extending in the first direction of the first antenna unit and an end portion extending in the first direction of the second antenna unit.

REFERENCE SIGNS LIST

1 System
100 Base station
200 Terminal device
2001 Antenna unit
2003 Wireless communication unit
2005 Communication control unit
2007 Storage unit
211 Communication device
2110 Antenna device
2111 Antenna element
2112 Element
2113, 2114 Feeding point
2115 Dielectric substrate
2116 Ground plate
2117 Slot

The invention claimed is:

1. An antenna device comprising:

a substantially planar dielectric substrate;

a plurality of antenna elements disposed on one surface of the dielectric substrate along a first direction horizontal to a plane of the dielectric substrate, and configured to respectively transmit or receive a first wireless signal and a second wireless signal having different polarization directions from one another; and a ground plate provided on substantially entire the other surface of the dielectric substrate, and provided with a long slot to extend in a second direction orthogonal to the first direction in a region corresponding to a region between a first antenna element and a second antenna element next to each other, wherein a length L in the second direction of the slot satisfies a conditional expression below:

[Math 1]

$$L > \frac{\lambda_g}{2}, \lambda_g = \frac{\lambda_0}{\sqrt{(\varepsilon_{r1} + \varepsilon_{r2})/2}}$$

where a wavelength of the wireless signal transmitted or received by each of the plurality of antenna elements is $\lambda_0$, a relative dielectric constant of the dielectric substrate is $\varepsilon_{r1}$, and a relative dielectric constant of a dielectric located on an opposite side of the dielectric substrate with respect to the ground plate is $\varepsilon_{r2}$.

2. The antenna device according to claim 1, wherein a distance d between respective centers of the first antenna element and the second antenna element satisfies a conditional expression below.

[Math 2]

$$\frac{\lambda_0}{2} \leq d < \lambda_0.$$

3. The antenna device according to claim 1, wherein a distance p along the first direction between a center of the first antenna element and the slot satisfies a conditional expression below.

[Math 3]

$$\frac{\lambda_0}{4\sqrt{\varepsilon_{r1}}} < p < d - \frac{\lambda_0}{4\sqrt{\varepsilon_{r1}}}.$$

4. The antenna device according to claim 1, wherein the first wireless signal has the polarization direction substantially coincident with first direction, the second wireless signal has the polarization direction substantially coincident with the second direction, and a first feeding point corresponding to the first wireless signal and a second feeding point corresponding to the second wireless signal are provided for each of the antenna elements.

5. The antenna device according to claim 4, wherein the first feeding point in the second antenna element is eccentrically provided in a direction of an end portion, of end portions in the first direction of the second antenna element, the end portion being on an opposite side of the first antenna element.

6. The antenna device according to claim 1, wherein the antenna element is configured as a planar antenna.

7. The antenna device according to claim 1, further comprising:

a first antenna unit and a second antenna unit each including the dielectric substrate, the plurality of antenna elements, and the ground plate, wherein the first antenna unit and the second antenna unit are held such that respective normal directions intersect with each other or the normal directions are twisted relative to each other, with respect to a predetermined housing.

8. The antenna device according to claim 7, further comprising: a coupling unit configured to couple an end portion extending in the first direction of the first antenna unit and an end portion extending in the first direction of the second antenna unit.

* * * * *